US008104117B2

(12) United States Patent
Heimbrock et al.

(10) Patent No.: US 8,104,117 B2
(45) Date of Patent: Jan. 31, 2012

(54) SIDERAIL AND CONTROL UNIT THEREFOR

(75) Inventors: Richard H Heimbrock, Cincinnati, OH (US); David M J Allgeier, Noblesville, IN (US); Todd P O'Neal, Fairfield, OH (US)

(73) Assignee: Hill-Rom Services, Inc.

( * ) Notice: Subject to any disclaimer, the term of this patent is extended or adjusted under 35 U.S.C. 154(b) by 426 days.

(21) Appl. No.: 12/402,013

(22) Filed: Mar. 11, 2009

(65) Prior Publication Data

US 2010/0229304 A1 Sep. 16, 2010

Related U.S. Application Data

(60) Provisional application No. 61/036,368, filed on Mar. 13, 2008.

(51) Int. Cl.
*A47C 21/08* (2006.01)
*A47C 31/00* (2006.01)

(52) U.S. Cl. ..... 5/425; 5/600; 5/503.1; 5/658

(58) Field of Classification Search ..... 5/425, 424, 5/600, 503.1, 658; 340/573.1, 825.19
See application file for complete search history.

(56) References Cited

U.S. PATENT DOCUMENTS

| | | | | |
|---|---|---|---|---|
| 4,023,757 | A | 5/1977 | Allard et al. | |
| 4,431,154 | A | 2/1984 | Hamm | |
| 6,486,792 | B1 * | 11/2002 | Moster et al. | 340/4.11 |
| 6,781,517 | B2 | 8/2004 | Moster et al. | |
| 6,913,150 | B1 | 7/2005 | Fountain | |
| 7,200,882 | B2 | 4/2007 | Heimbrock | |
| 7,494,102 | B1 | 2/2009 | Deal | |
| 7,779,493 | B2 * | 8/2010 | Lemire et al. | 5/600 |
| 2003/0076238 | A1 * | 4/2003 | Moster et al. | 340/825.19 |
| 2005/0007258 | A1 * | 1/2005 | Moster et al. | 340/825.19 |
| 2005/0172405 | A1 * | 8/2005 | Menkedick et al. | 5/618 |
| 2007/0130692 | A1 * | 6/2007 | Lemire et al. | 5/618 |
| 2007/0180616 | A1 * | 8/2007 | Newkirk et al. | 5/425 |
| 2010/0229304 | A1 * | 9/2010 | Heimbrock et al. | 5/425 |

FOREIGN PATENT DOCUMENTS

| | | | |
|---|---|---|---|
| DE | 20206765 | U1 | 7/2002 |
| DE | 202005007348 | U1 | 9/2006 |
| WO | 99/52487 | A1 | 10/1999 |

OTHER PUBLICATIONS

European Search Report accompanied by the Examiner's Preliminary Opinion, "Application No. EP 09250695", (Apr. 15, 2010), The Hague.

* cited by examiner

*Primary Examiner* — Robert G Santos
(74) *Attorney, Agent, or Firm* — Kenneth C. Baran

(57) ABSTRACT

An occupant support apparatus 10 includes a frame 12 and an occupant support deck 14 above which an occupant is supportable. A siderail 22 has a raised position in which at least a portion of the siderail is higher in elevation than the patient support deck. The siderail includes a recess 42. The occupant support also includes a control unit 44 having user inputs configured to be engaged by a user. The control unit is movable relative to the siderail between a first position in which at least a majority of the patient control unit is received in the recess and a second position in which at least a majority of the control unit resides outside the recess and extends past a perimeter of the siderail. In one embodiment the control unit also has an upper portion 50, which is pivotable about a generally vertical axis.

33 Claims, 23 Drawing Sheets

SIDERAIL AND CONTROL UNIT THEREFOR

This application claims the benefit of provisional U.S. patent application 61/036,368 entitled "Siderail with Ergonomic Patient Pendant, Soft Insert, and Protected Switching" filed on Mar. 13, 2008, the contents of which are incorporated herein by reference.

BACKGROUND

The subject matter of the present application relates to patient support apparatuses, such as hospital beds, and particularly to siderails of patient support apparatuses. More particularly, the subject matter of the present application relates to patient and caregiver control units that are coupled to siderails and that have user inputs which are used to control functions of the associated patient support apparatus. The subject matter of the present application also relates to devices that cushion patient contact with hard surfaces of siderails.

Patient support apparatuses, such as hospital beds, stretchers, and the like, typically have a number of siderails that are raised to prevent a patient from falling off of a mattress of the patient support apparatus. Some hospital beds and stretchers have patient controls and caregiver controls on the siderails so that patients and caregivers can use the controls to control functions of the patient support apparatus and/or to control other functions of other devices such as room lights, televisions, a radios, and so forth. Depending upon a patient's size or condition, the patient controls can sometimes be difficult for the patient to reach or use.

The caregiver controls on the siderails of patient support apparatuses are typically located on the outside portion of the siderail that faces away from the patient. The caregiver controls may include push buttons or membrane switches or similar such switches. When a caregiver leans on, or otherwise comes into contact with, a siderail of a patient support apparatus while caring for a patient, there is a possibility that the caregiver may inadvertently contact one or more of the caregiver controls thereby actuating a function which the caregiver is not intending to actuate, such as raising or lowering a head section of a hospital bed.

Siderails of hospital beds and stretchers are oftentimes constructed of hard plastic moldings or shells which are fastened in place over metal siderail frames. Accordingly, siderails are fairly hard structures when bumped into by a patient's knees or elbows, or any other portion of a patient for that matter. There are various siderail pads or similar accessories which can be purchased and attached to siderails to cushion inadvertent impacts by patients with siderails. However, such pads may fit onto siderails of only a particular shape and the pads have to be stored separately when not in use.

SUMMARY

The present invention comprises a patient support apparatus, or a component thereof, such as a siderail, that has any one or more of the features listed in the appended claims and/or any one or more of the following features, which alone or in any combination may comprise patentable subject matter:

A patient support apparatus may comprise a frame which, in turn, may include a patient support deck above which a patient is supported. Typically, some sort of mattress is provided on the patient support deck, but it is not uncommon for frames of patient support apparatuses, such as hospital beds, stretchers, and the like, to be made and sold without such mattresses. Thus, according to this disclosure a mattress is considered to be an optional component of a patient support apparatus, not required.

The patient support apparatus may have a siderail coupled to the frame. The siderail may have a raised position in which at least a portion of the siderail is higher in elevation than the patient support deck to provide a barrier inhibiting a patient from exiting off the patient support deck. The siderail may be movable to a lowered position permitting the patient to exit the patient support deck without obstruction from the siderail.

The siderail may comprise a top rail portion and an end rail portion. The end rail portion may include a recess. The patient support apparatus may further have a patient control unit which, in turn, may have user inputs configured to be engaged by the patient to control functions of the patient support apparatus. The patient control unit may be coupled to the siderail and may be movable relative to the siderail between a first position in which at least a majority of the patient control unit is received in the recess of the end rail portion and a second position in which at least a majority of the patient control unit is situated outside the recess and extends upwardly with respect to the top rail portion.

The patient control unit may slide generally vertically within the recess when moving between the first and second positions. At least a first portion of the patient control unit may be pivotable about a generally vertical axis when the patient control unit is in the second position. The patient control unit may include a base portion that remains in the recess when the patient control unit is in the second position. The first portion of the patient control unit may be pivotable about the generally vertical axis relative to the base unit and the user inputs may be carried by the first portion of the patient control unit. One or more detent mechanisms may be provided on a bottom surface of the first portion and/or on an upper surface of the top and/or end rail portions such that when the first portion of the patient control unit is pivoted about the vertical axis after the patient control unit has been moved to the second position, the one or more detent mechanisms will tend to retain the first portion at selected angular orientations such as plus or minus 45 degrees and/or plus or minus 90 degrees from the neutral position.

The user inputs of the patient control unit may be accessible to the patient when the control unit is in both the first and second positions. However, the patient control unit and the recess may be configured such that the patient control unit may be removed from the recess, flipped around, and then reinserted back into the recess in an orientation in which the user inputs are inaccessible to the patient. Thus, the patient control unit may be inserted into the recess so that the user inputs face generally toward the patient support deck through an open front of the recess or so that the user inputs face generally away from the patient support deck toward a generally vertical wall of the siderail that bounds the back of the recess. When the patient control unit is removed from the recess altogether, it may held by the patient away from the siderail.

A cord may extend from the patient control unit and may couple to a winder carried by the siderail. The winder may be operable to automatically wind up the slack of the cord when the patient control unit is returned to the recess. The cord may include one or more electrical conductors through which signals regarding which of the user inputs are being used by the patient are provided to a controller of the patient support apparatus. The patient control unit may comprise an elongated hand-held pendant and the recess may comprise a vertically oriented elongated recess that is substantially open at its top and front and substantially closed at its sides, bottom, and back.

It is contemplated by this disclosure that other types of patient support apparatuses, such as chairs may be outfitted with a similar type of recess and patient control unit arrangement. For example, an armrest of a chair may be provided with a recess that permits an associated patient control unit to be moved substantially vertically within the recess between raised and lowered positions, with the user inputs of the control unit being situated above the arm rest when the control unit is in the raised position. This type of recess may also be provided on an overbed table, such as in a housing of the overbed table from which a table extends in a cantilevered manner. When the control unit is in the raised position, the user inputs may be situated above the table of the overbed table.

The siderail may have a main siderail body and a flexible panel coupled to the main siderail body. The flexible panel may be less rigid than the main siderail body so as to flex more readily than the main siderail body when contacted inadvertently by a patient that is supported above the patient support deck. The main siderail body may comprise a top portion, a bottom portion, a head end portion and a foot end portion, such that, in some embodiments, a large opening may be defined by the top, bottom, head end, and foot end portions of the main siderail body. At least a portion of the flexible panel may be situated within the large opening. Head end and foot end portions of the flexible panel may be coupled to the main siderail body and a middle portion of the flexible panel may bow outwardly toward the patient support deck.

The head end and foot end portions of the flexible panel may be coupled to the main siderail body and the middle portion of the flexible panel may bowing out of the large opening and toward the patient support deck. The flexible panel may have a top edge that may be situated below, and that may be spaced-apart from, the top portion of the main siderail body. At least a portion of a bottom edge of the middle portion of the flexible panel may be situated above, and may be spaced-apart from, the bottom portion of the main siderail portion.

The flexible panel may have a plurality of holes provided therein. The flexible panel may be translucent and may be able to be lit up by at least one light source. Thus, the flexible panel may be made of a material that provides a light pipe type of effect. The at least one light sources may comprise, for example, at least one light emitting diode. The at least one light source may be operable to light up the flexible panel in a first color, green for example, and to light the flexible panel in a second color, yellow or red for example. The light source may be a single LED that is operable to shine light of different colors, such as green and amber or green and red.

The patient support apparatus may also have a caregiver control unit. In some embodiments, the main siderail body may have a top portion and the caregiver control unit may extend downwardly from the top portion. In other embodiments, the main siderail body may have a bottom portion and the caregiver control unit may extend upwardly from the bottom portion. In each of these embodiments, the flexible panel may be configured to bow away from the caregiver control unit and toward the patient support deck.

According to this disclosure, a patient support apparatus may comprise a frame, a siderail coupled to the frame, and a caregiver control unit coupled to the siderail. The caregiver control unit may have a housing with recessed grooves. The caregiver control unit may have user inputs associated with the grooves such that areas of the housing adjacent the grooves inhibit inadvertent activation of the user inputs.

The recessed grooves each may have a substantially vertical orientation. Each of the recessed grooves may be shallower at end regions of the respective groove as compared to a middle region of the respective groove. The user inputs may comprise, for example, field disturbance switches and/or capacitive switches. The shape and orientation of the recessed grooves, along with the types of switches used, may facilitate easy cleaning of the caregiver control unit by allowing for wipe down cleaning through the recessed grooves. The caregiver control unit may comprise a graphical display screen carried by the housing above the recessed grooves.

The siderail may comprise a top rail defining a generally horizontal axis. The caregiver control unit may be coupled to the top rail and may be pivotable about the generally horizontal axis. The siderail may comprise a bottom portion and an upwardly protruding portion situated about midway between a head end and foot end of the bottom portion. A cavity may be provided in the upwardly protruding portion and in the bottom portion. The cavity may be sized to receive the caregiver control unit therein. An upper portion of the caregiver control unit may be pivotably coupled to an upper region of the upwardly protruding portion for pivotable movement about a generally horizontal axis such that the caregiver control unit is movable between a storage position within the cavity and a use position extending out of the cavity.

Additional features, which alone or in combination with any other feature(s), such as those listed above, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION

Figure 1:
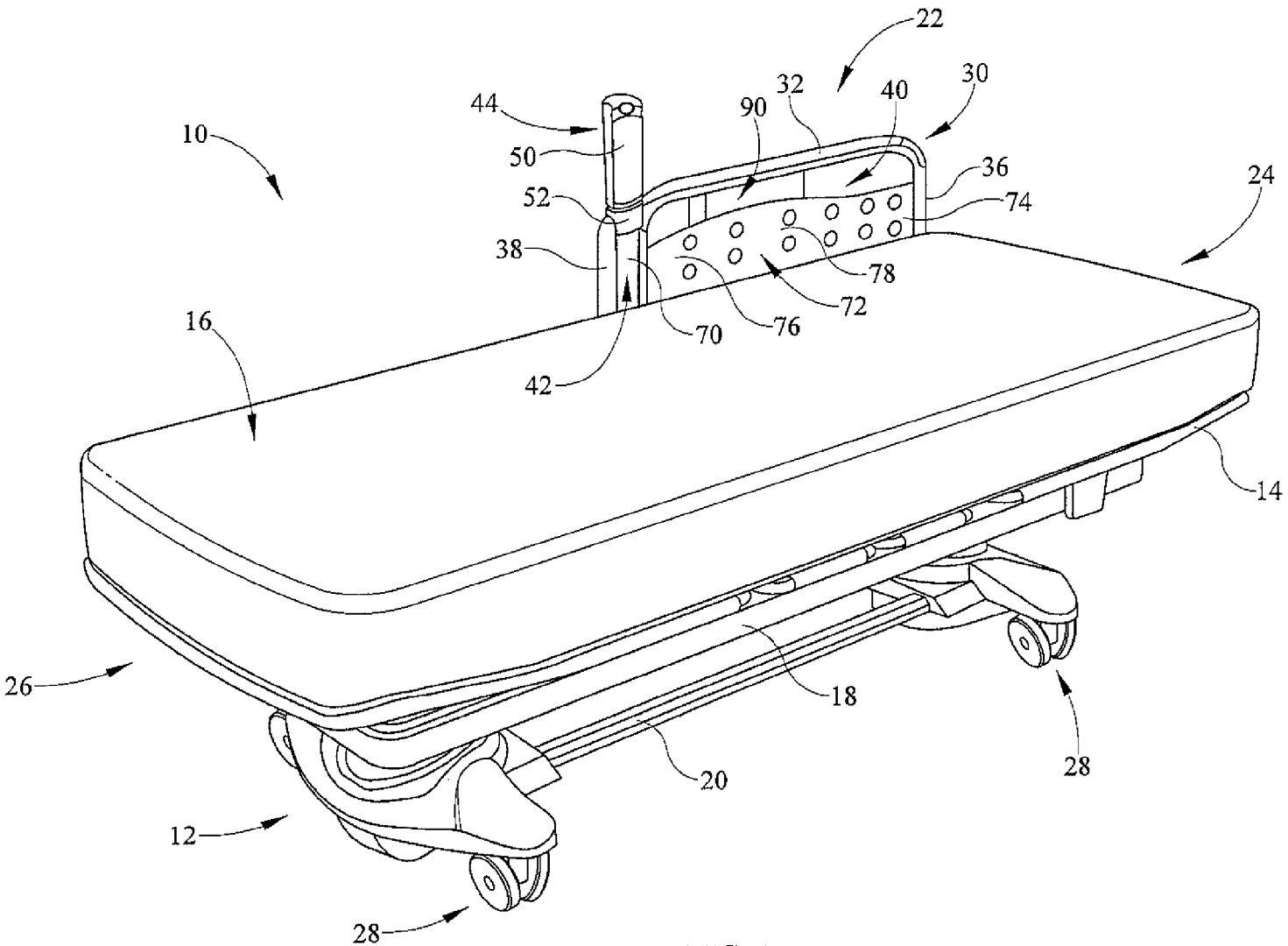
FIG. 1 is a perspective view of a patient support apparatus showing a patient control unit in a raised position relative to a siderail of the patient support apparatus.

A patient support apparatus 10 includes a frame 12 which, in turn, includes a patient support deck 14 which supports a mattress 16 as shown in FIG. 1. Mattress 16 is a foam mattress in some embodiments and is an air mattress in other embodiments. It is contemplated by this disclosure that mattress 16 may have any number of different types of support elements and/or layers which are suitable for supporting a patient. Illustrative patient support apparatus 10 is a hospital bed. However, the teachings of this disclosure are applicable to other types of patient support apparatuses such as stretchers, gurneys, wheeled chairs, and the like. Patient support apparatus 10 is sometimes referred to herein a bed 10 or hospital bed 10. As is the case with many hospital beds, bed 10 has casters 28 at the corner regions of base frame 20.

Patient support deck 14 includes a number of deck sections. In some embodiments, for example, deck 14 has three sections such a head or back section, a seat/thigh section, and a foot section. In other embodiments, deck 14 has four sections such as a head or back section, a seat section a thigh section, and a foot section. In still other embodiments, deck has only two sections and in further embodiments, deck 14 has more than four deck sections.

As is well know in the art, and depending upon the number of deck sections, bed 10 includes an appropriate number of powered drivers (not shown), such as electric motors, linear actuators, hydraulic actuators, pneumatic actuators, and the associated components (e.g., circuitry, linkages, pumps, reservoirs, compressors, etc.), to impart movement to associated deck sections to place deck 14 into a variety of positions. Illustrative bed 10 also includes an elevation adjustment mechanism (not shown) to raise, lower, and tilt an upper frame 18 of frame 12 relative to a base frame 20 of frame 12. The elevation adjustment mechanism also includes powered drivers, such as those mentioned above along with the associated components.

See U.S. Pat. No. 7,296,312, which is hereby incorporated herein by this reference, for an example of beds that use linear actuators and associated components to articulate deck sections into different positions and to raise, lower, and tilt an upper frame relative to a base frame. See U.S. Pat. No. 5,715,548, which is hereby incorporated herein by this reference, for an example of a bed that uses hydraulic actuators and associated components to articulate deck sections into different positions and to raise, lower, and tilt an upper frame relative to a base frame.

Figure 7:
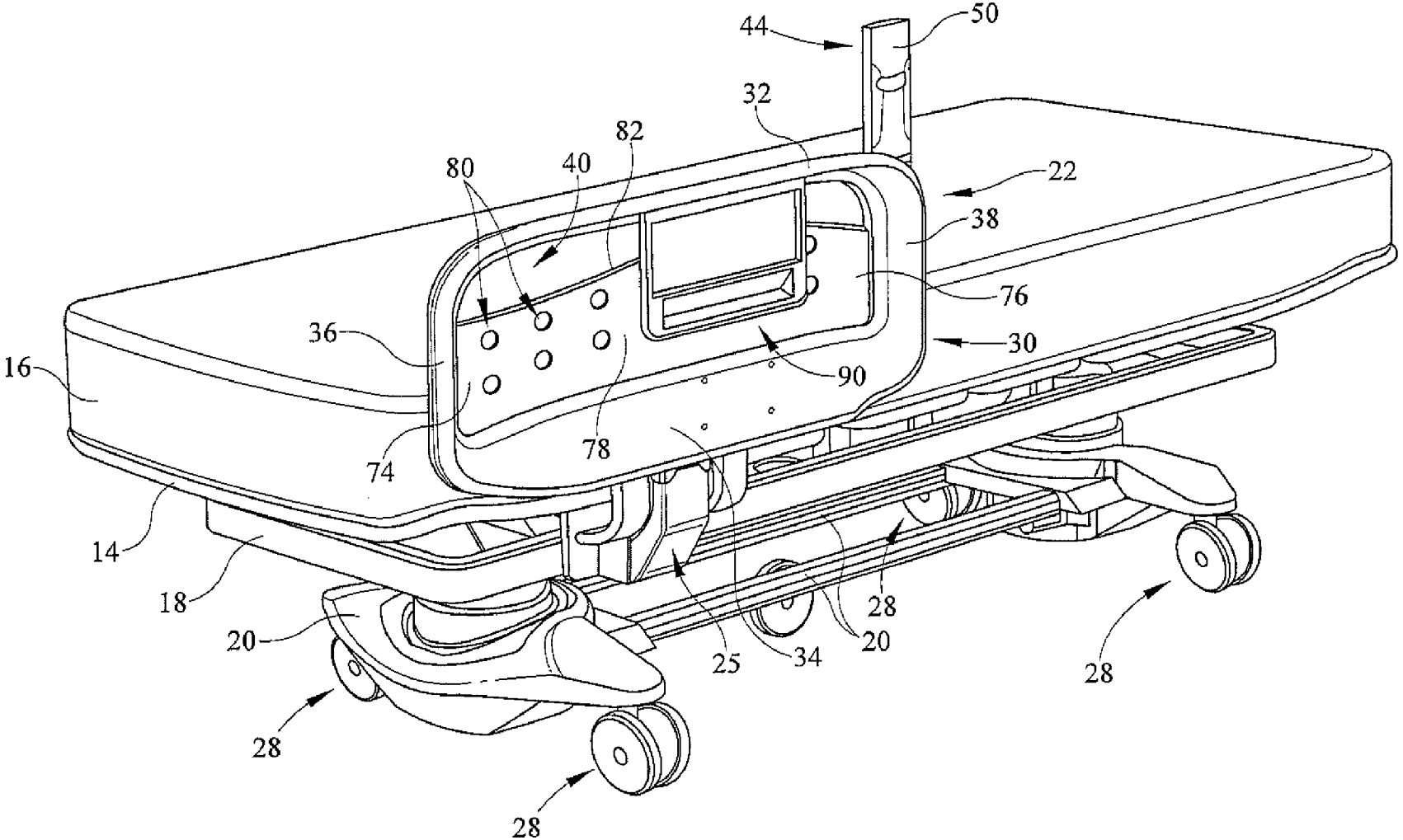
FIG. 7 is a perspective view of the patient support apparatus of FIG. 1, as viewed from another vantage point, showing a caregiver control unit extending downwardly from a top rail of the siderail and showing a flexible panel extending from a head end portion of the siderail to a foot end portion of the siderail, with part of a middle portion of the flexible panel being situated behind the caregiver control unit.

Bed 10 has a plurality of siderails 22 that are coupled to frame 12. Siderails 22 are coupled to upper frame 18 and/or to one or more deck sections of deck 14. Only one siderail 22 is shown in FIG. 1, it being understood that, in practice, bed 10 has at least one additional similar siderail 22 on an opposite side of bed. The siderail shown in FIG. 1 is near a head end 24 of bed 10. Additional siderails may also be provided near a foot end 26 of bed 10 on opposite of mattress 16. Each siderail 22 is movable between a raised position, as shown in FIG. 1, and a lowered position (not shown). In the raised position, at least a portion of the siderail 22 is higher in elevation than patient support deck 14 and the mattress 16 to provide a barrier inhibiting a patient from exiting the bed 10. When the siderails 22 are in the lowered position, the patient is able to exit the bed 10 without obstruction from the siderails 22. A linkage mechanism 25, shown in FIG. 7, is provided to control the movement of the siderails 22 between the raised and lowered positions and to releasably lock the siderails 22 in respective raised positions. See, for example, U.S. Pat. Nos. 7,073,220; 6,779,209; and 6,182,310 for examples of linkage mechanisms similar to mechanism 25 and see U.S. Pat. No. 3,932,903 for an example of an alternative linkage mechanism. Each of U.S. Pat. Nos. 7,073,220; 6,779,209; 6,182,310; and 3,932,903 are hereby incorporated by reference herein.

Figure 4:
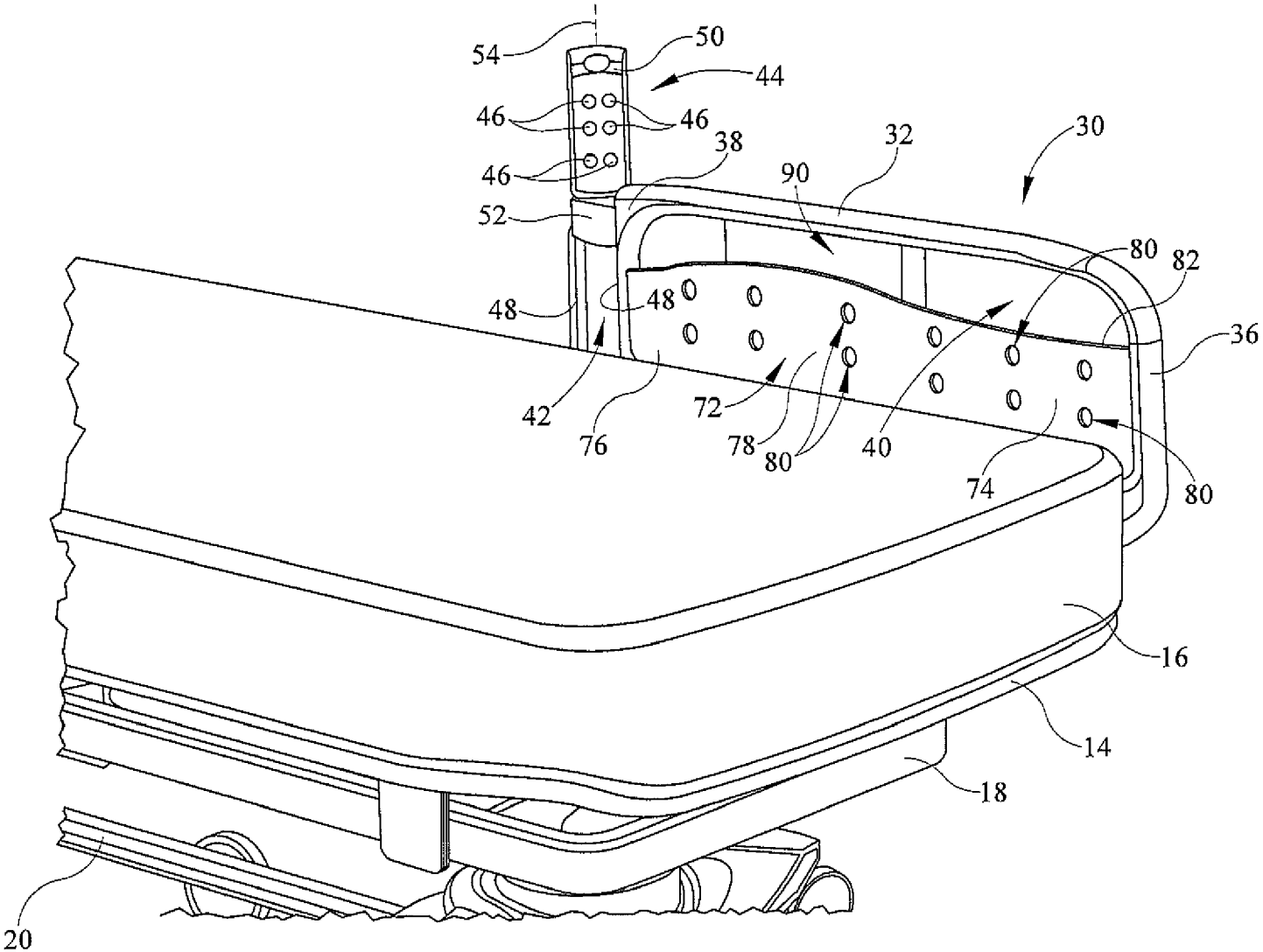
FIG. 4 is a perspective view, similar to FIG. 3, showing an upper portion of the patient control unit being pivotable relative to a base portion of the patient control unit about a generally vertical axis when the patient control unit is in the raised position.
Figure 5:
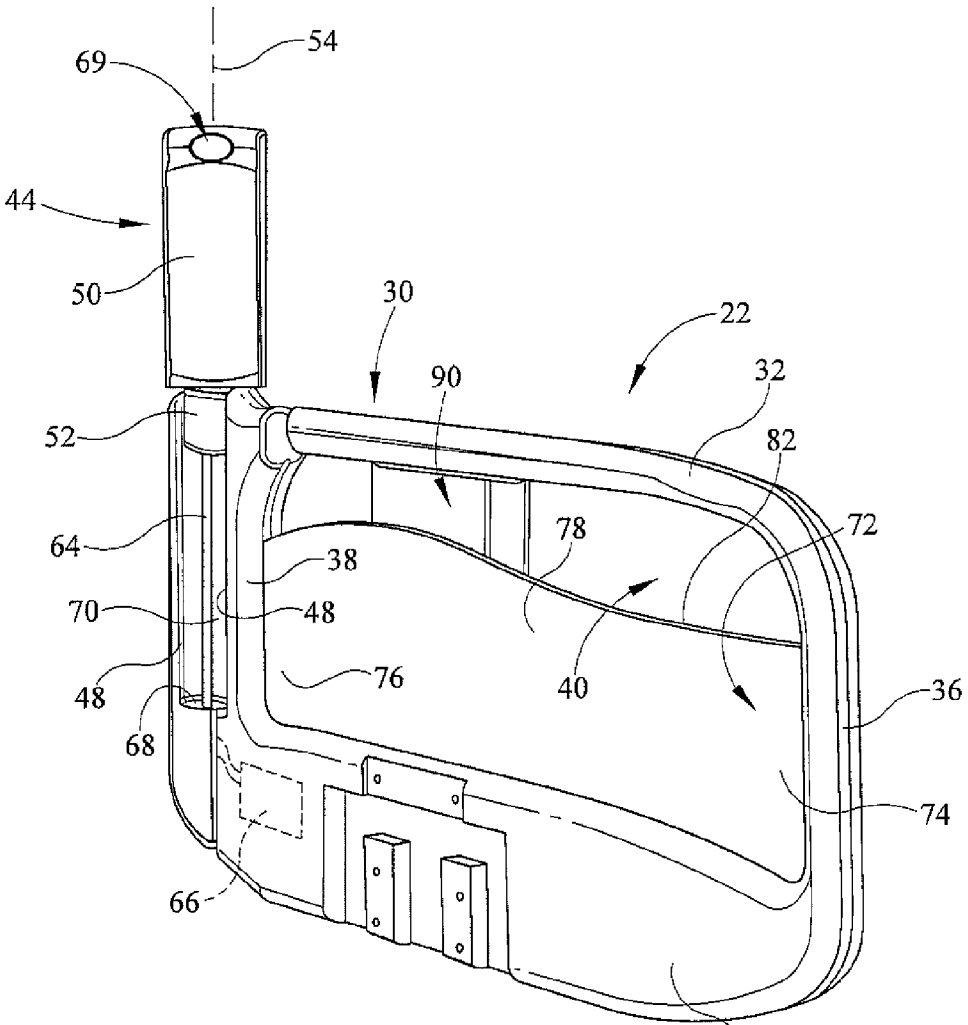
FIG. 5 is an enlarged perspective view of the siderail with the patient control unit in the raised position showing a cord extending from a bottom of the base portion of the control unit to a winder (in phantom) carried by the siderail.

Siderail 22 includes a main siderail body 30 having a top rail portion 32, a bottom rail portion 34, a head end rail portion 36, and a foot end rail portion 38 as shown best in FIG. 5. Rail portions 32, 34, 36, 38 are interconnected and thus, in the illustrative example, main siderail body 30 serves as a peripheral frame structure having a fairly large opening 40 therethrough. End rail portion 38 has a recess 42 which is sized and configured to receive a patient control unit 44 therein. Patient control unit 44 has user inputs 46, shown generically in FIG. 4, which are configured to be engaged by the patient to control functions of the patient support apparatus 10. For example, user inputs 46 may be used by the patient to move the various deck sections of deck 14 to different positions, to raise, lower and tilt frame 16. In some embodiments, user inputs 46 may be used by the patient to control room lighting, a television, a radio and to place a nurse call to a nurse call system. Thus, in such embodiments, user inputs 46 are used to provide signals via appropriate circuitry and communication links (wired and/or wireless) to devices and equipment that are or are not included as part of bed 10.

Figure 2:
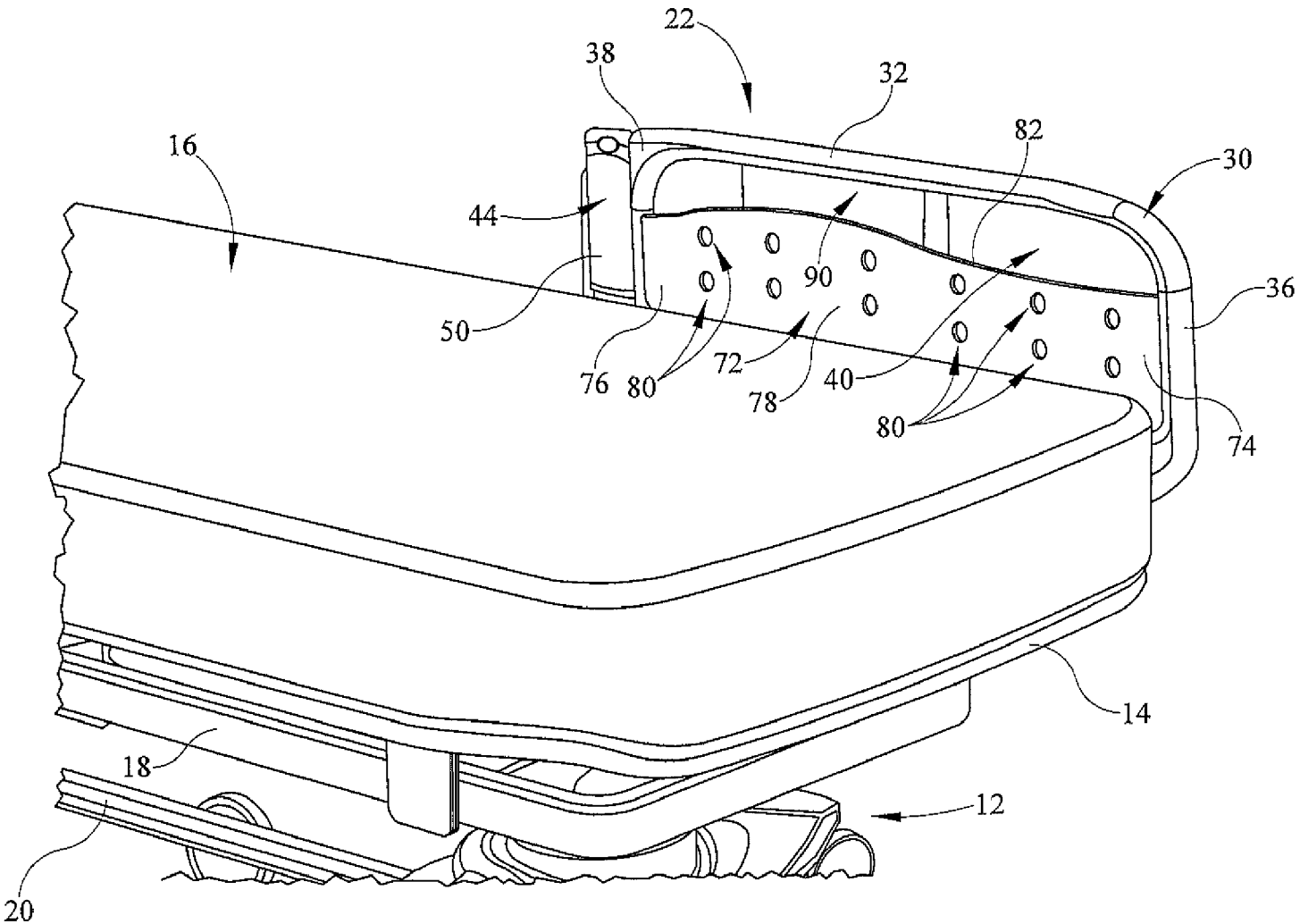
FIG. 2 is a perspective view of a portion of the patient support apparatus of FIG. 1 showing the patient control unit moved to a lowered position and situated within a recess provided in an end rail portion of the siderail.
Figure 3:
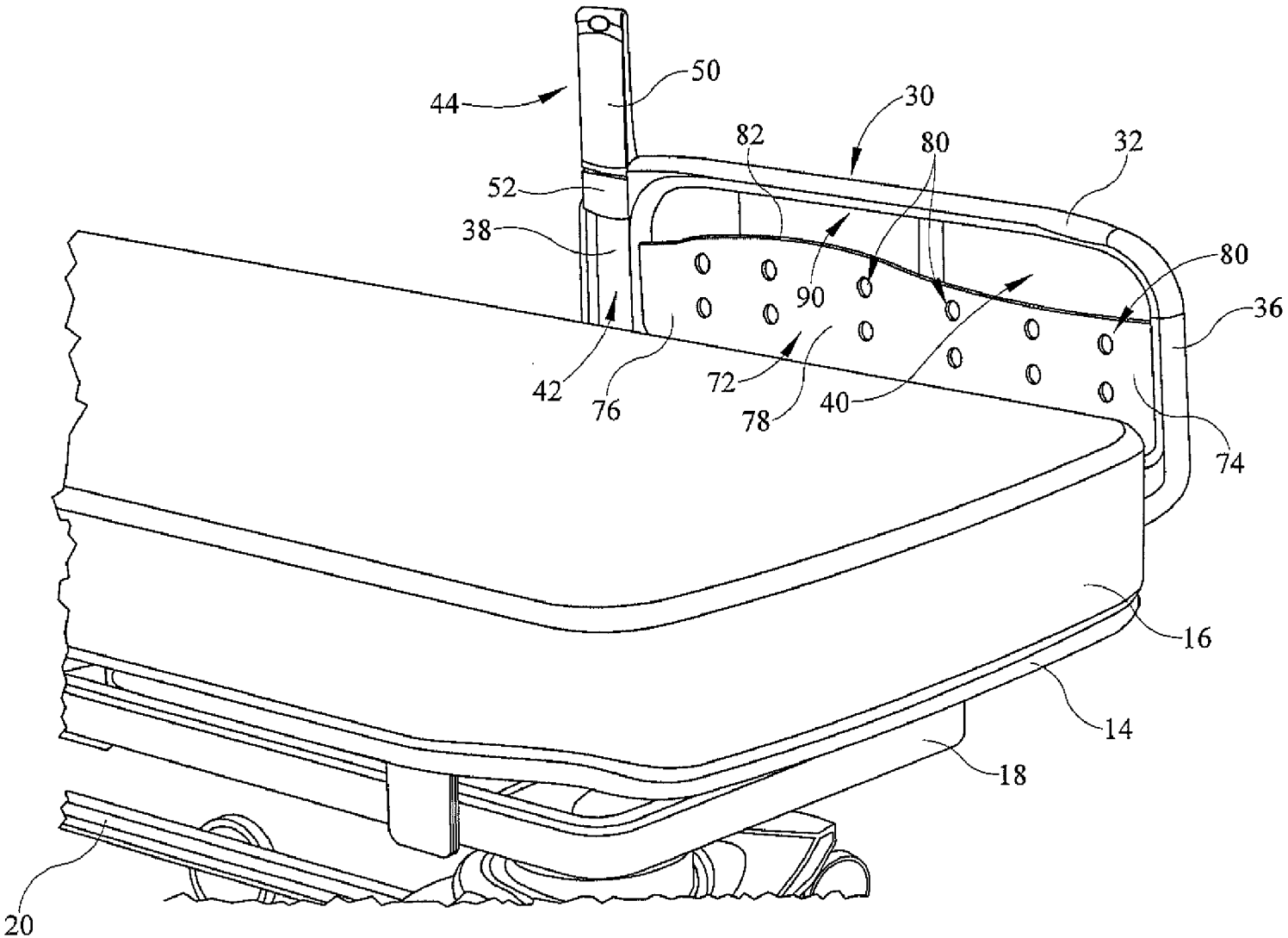
FIG. 3 is a perspective view, similar to FIG. 2, showing the patient control unit moved generally vertically upwardly in the recess to the raised position.
Figure 17:
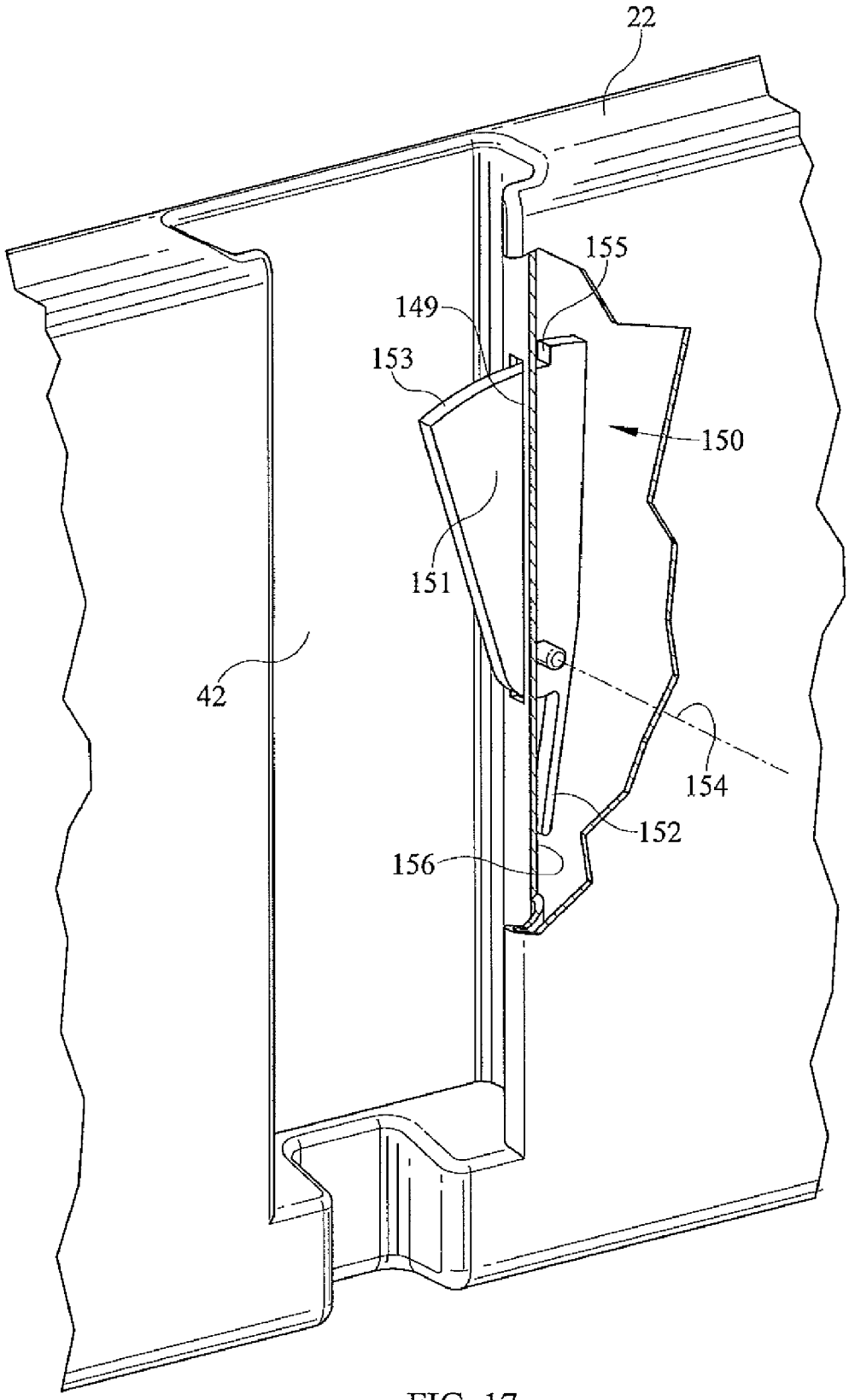
FIGS. 17-18 are a partially cut-away schematic perspective view and a schematic side elevation view showing a locking device for holding the control unit in an intermediate position.
Figure 18:
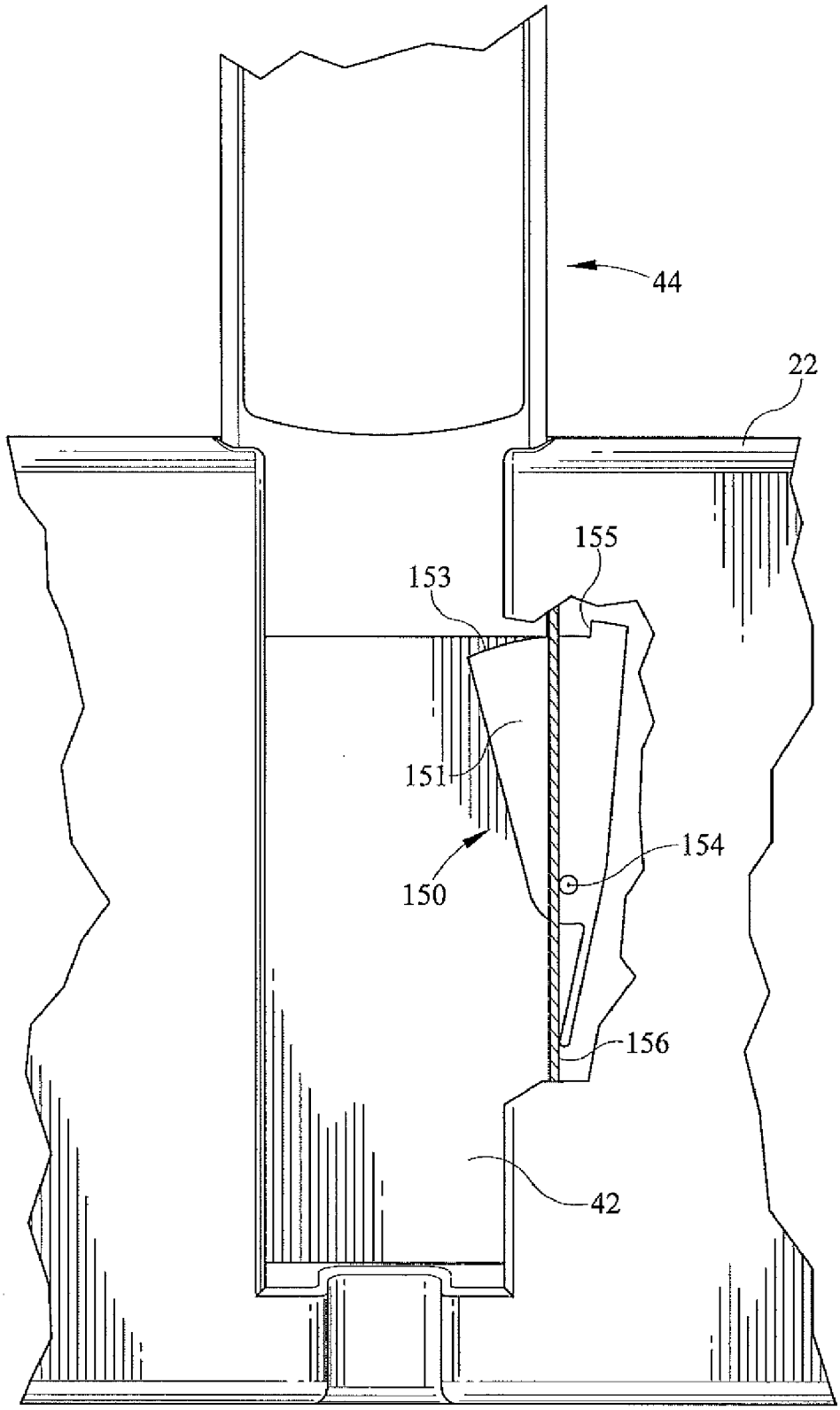

Patient control unit 44 is coupled to siderail 22 and is received in recess 42 for generally vertical movement relative to the siderail 22 between a first or lowered position in which the majority, if not all, of the patient control unit 44 is received in the recess 42 of the end rail portion 38, as shown in FIG. 2, and a second or raised position in which a majority of the patient control unit 44 is situated outside the recess 42 as shown in FIGS. 1 and 3-5. If desired, a detent, locking mechanism or friction fit may be employed to hold the unit in one or more intermediate positions between the first and second positions. For example, FIGS. 17-18 show a siderail 22 with a slot 149 bordering one side of the recess 42. A plastic latch 150 includes a main body 151 vertically aligned with the slot and a slender, flexible finger 152. The main body includes a ledge 153 and a shoulder 155. The latch is pivotable about axis 154. As illustrated, the latch intrudes into the recess 42 so that a control unit 44 can rest on the ledge. To lower the unit 44 further into the recess, a user first presses the main body of the latch into the slot, causing the latch to rotate about axis 154 (clockwise as seen in the illustrations) and then slides the control unit 44 vertically lower in the recess. The rotation of the latch brings finger 152 into contact with an interior wall 156 of the siderail causing the finger to deflect and exert a spring force tending to counterrotate the latch back in the opposite (counterclockwise) direction. The counterrotation is resisted by the side of the control unit, which now occupies at least the portion of the recess neighboring the slot. When the control unit is moved vertically upwardly above the elevation of the ledge, the spring force exerted by the finger rotates the main body of the latch back into the recess where it can support the control unit. The shoulder 155 contacts interior wall surface 156 to prevent over-rotation of the latch When unit 44 is in the raised position, unit 44 extends upwardly with respect to the top rail portion 32. That is, a large portion of unit 44 is situated at a higher elevation than top rail portion 32. By allowing unit 44 to move to the raise position, the user inputs 46 are easier for some patients to reach because such patients may find that the user inputs 46 are too low for their liking when unit 44 is in the lowered position.

Figure 10:
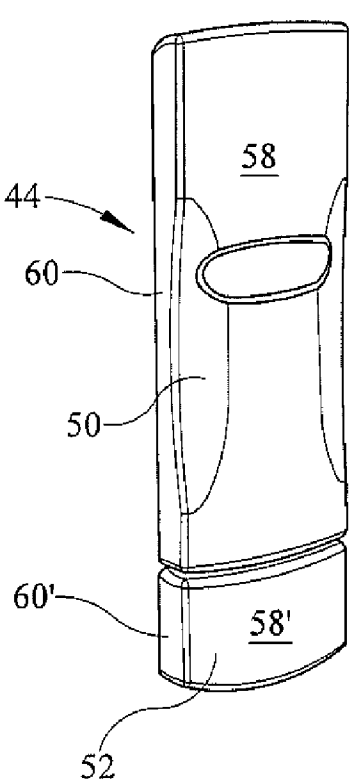
FIG. 10 is an enlarged perspective view of a back of the patient control unit.
Figure 9:
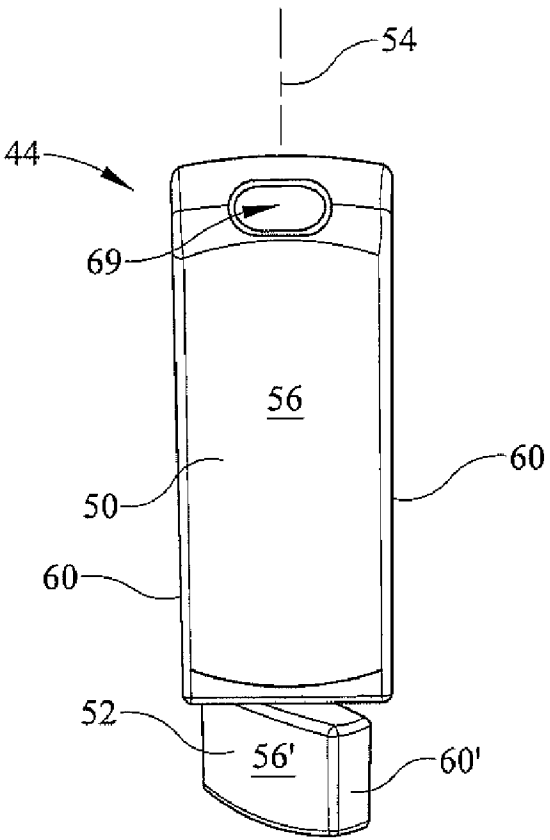
FIG. 9 is an enlarged perspective view, similar to FIG. 8, showing the upper portion of the patient control unit pivoted relative to the base portion of the patient control unit.
Figure 8:
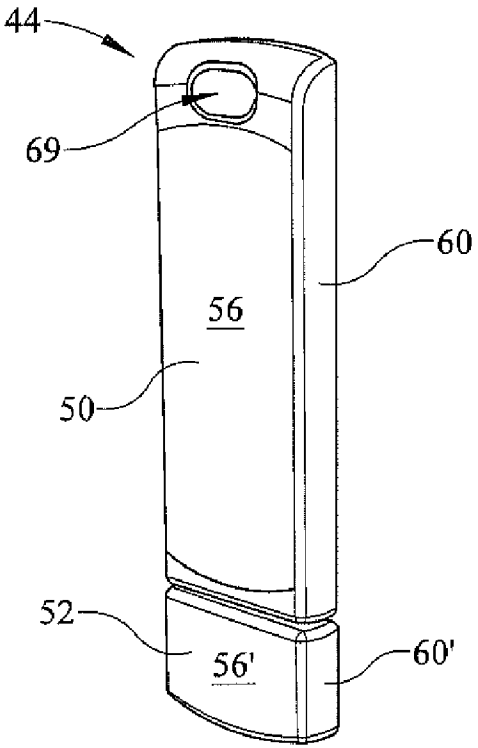
FIG. 8 is an enlarged perspective view of a front of the patient control unit.
Figure 11:
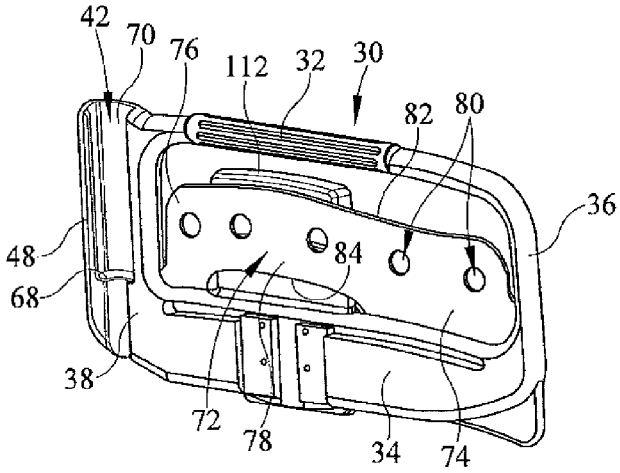
FIG. 11 is perspective view of another embodiment of a siderail showing a caregiver control unit housing extending upwardly from a bottom rail portion of the siderail and showing a flexible panel with its head and foot end portions situated within a large opening of the siderail and showing a middle portion of the flexible panel shielding part of the caregiver control unit from view.
Figure 12:
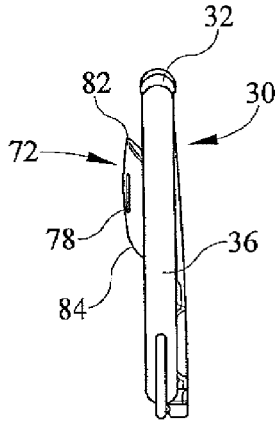
FIG. 12 is an end view of the siderail of FIG. 11 showing the middle region of the flexible panel bowed outwardly out of the large opening of the siderail.
Figure 19:
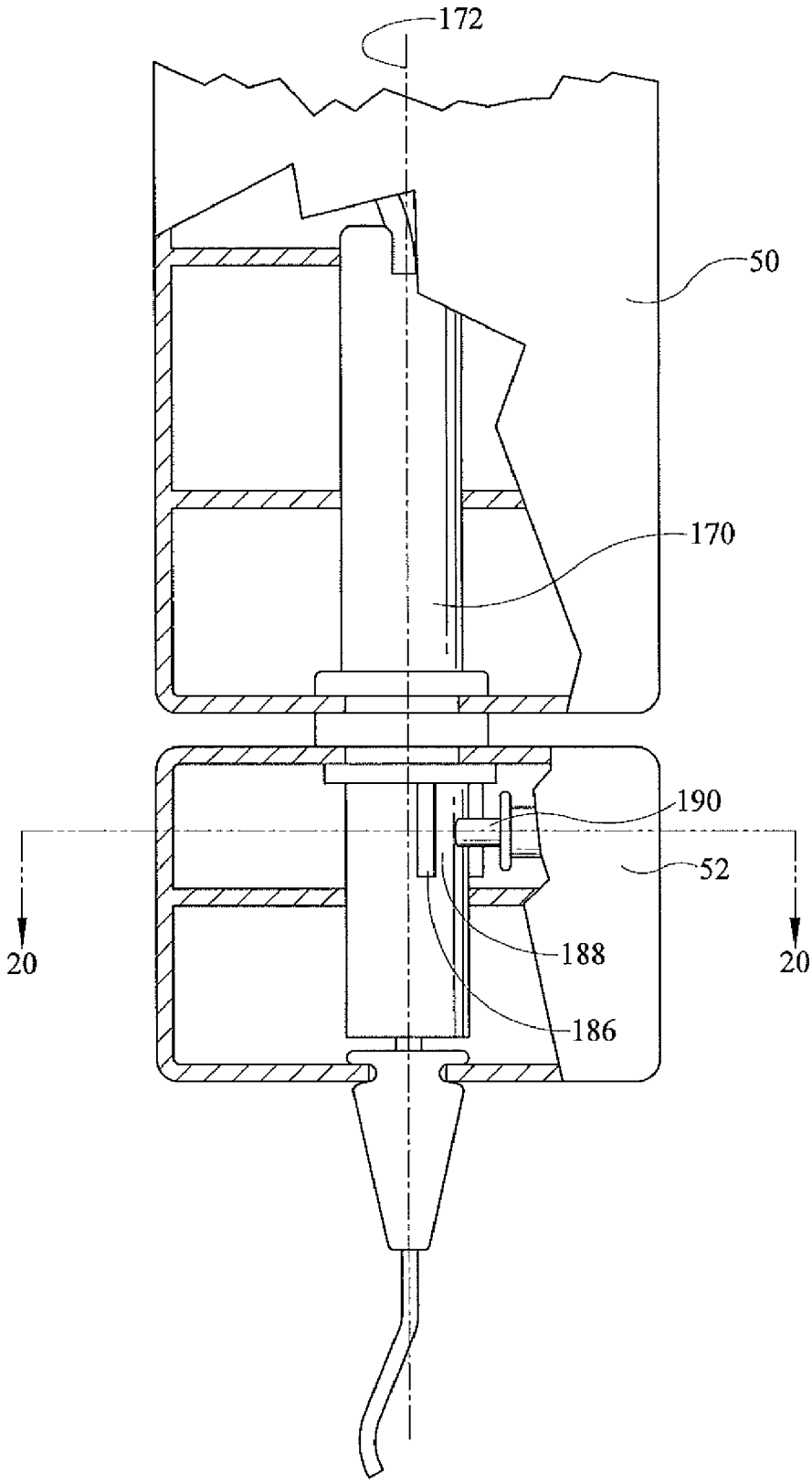
FIG. 19 is a side elevation view of the control unit partially broken away to show a pin connection between the upper and base portions of the unit.
Figure 20:
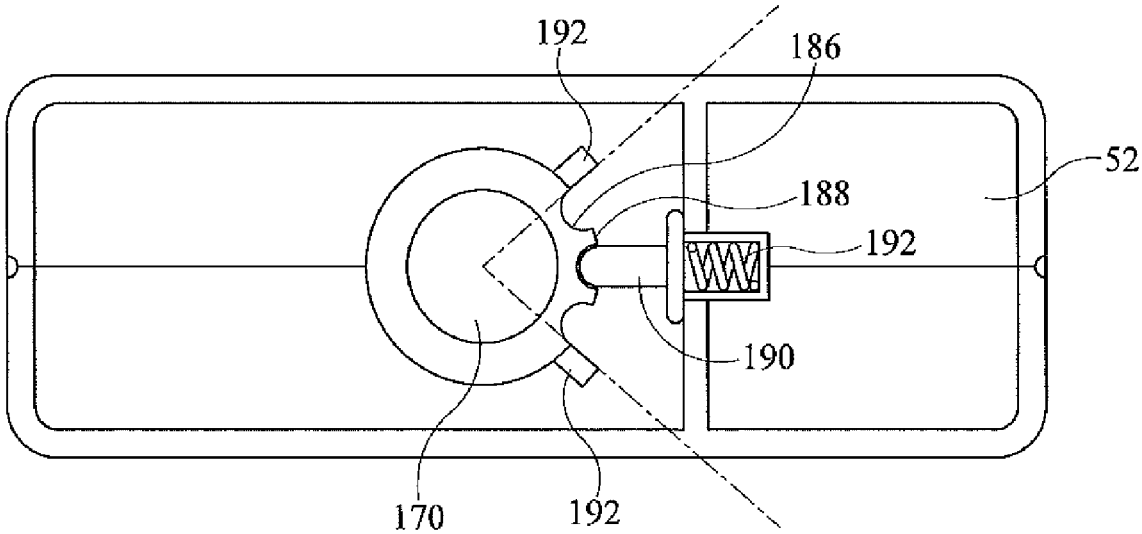
FIG. 20 is a view taken substantially in the direction 20-20 of FIG. 19.
Figure 21:
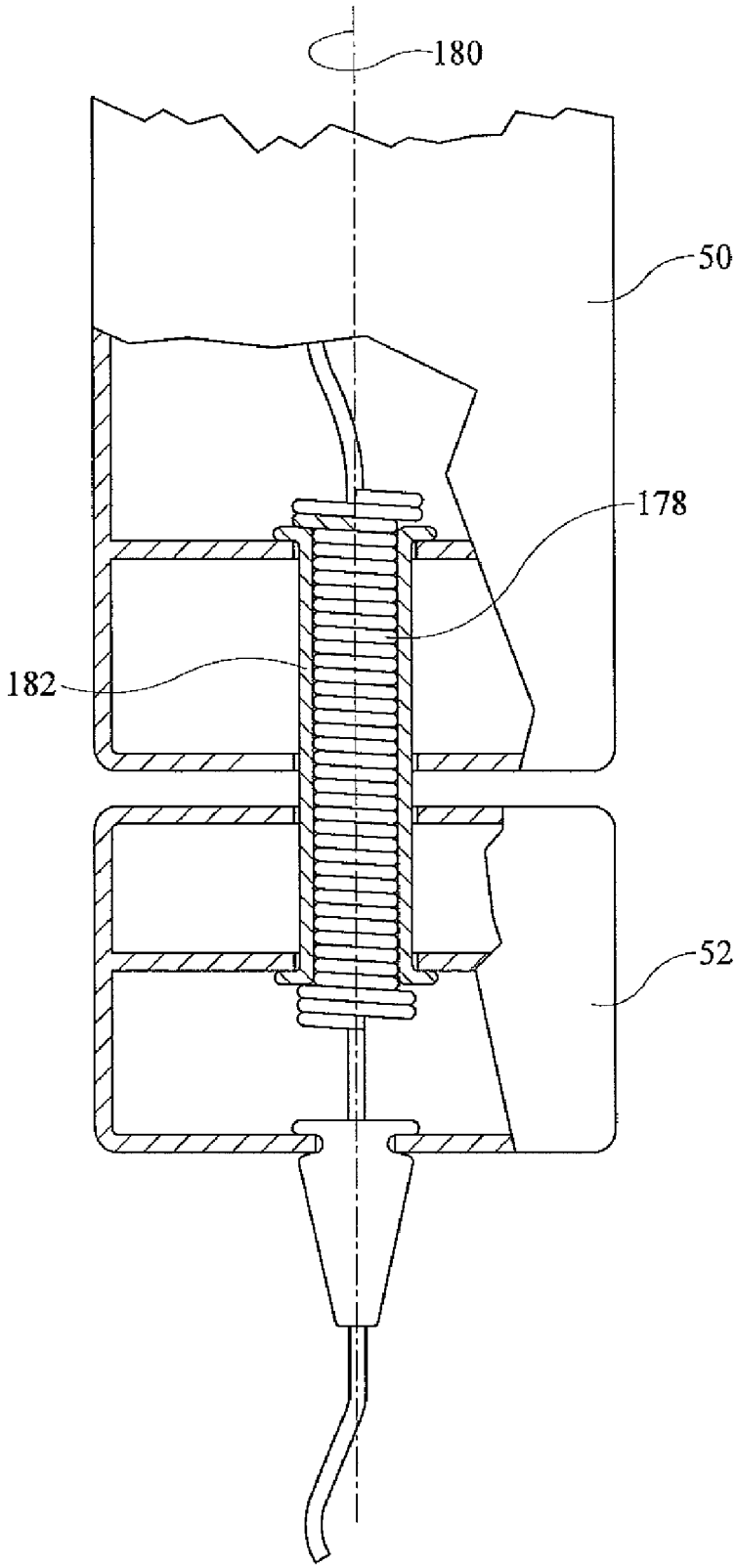
FIG. 21 is a view similar to FIG. 19 showing a spring connection.

Patient control unit 44 slides generally vertically within the recess 42 when moving between the first and second positions. End rail portion 38 has a slight lip, ridge, or overhang 48 near the opposite sides of the open front of recess 42 as shown in FIG. 5. Lips 48 retain unit 44 within recess and prevent unit 44 from falling out of the open front of recess 42 when unit 44 is in the lowered position. Unit 44 includes a first or upper portion 50 and a base portion 52 as shown in FIGS. 8-10. Referring to FIGS. 19-20, the upper portion and base are pivotably linked together by, for example, a rigid connector pin 170 whose axis 172 is colinear with a control unit pivot axis 54. Alternatively, the connection may be one that, in addition to permitting the above described pivotability, also permits the upper portion 50 (and the pivot axis) to deflect longitudinally and laterally relative to the base 52. As seen in FIG. 21, an example of such a connection is a coil spring 178 extending between the upper and base portions with its undeflected axis 180 colinear with pivot axis 54. Because the perimeter of the spring can collect dirt and can be difficult to clean thoroughly, a flexible sleeve 182 circumscribes the spring. The sleeve is less likely to collect dirt and is easier to clean. User inputs 46 are carried by upper portion 50. Thus, upper portion 50 of unit 44 is on the order of 3 to 5 times larger than base portion 52.

Base portion 52 remains in the recess 42 when the patient control unit 44 is in the raised position, whereas the upper portion 50 is situated outside, and above, recess 42 when unit 44 is in the raised position. First portion 50 of the patient control unit 44 is pivotable about a generally vertical axis 54 when the patient control unit is in the raised position as shown in FIGS. 4, 5, and 9. When unit 44 is in the lowered position in recess 42, front, back and side surfaces 56, 58, 60 of upper portion 50 are aligned, and are substantially coplanar, with front, back and side surfaces 56', 58', 60' of base portion. When unit 44 is moved to the raised position and upper portion 50 of unit is pivoted about axis 54, surfaces 56, 58, 60 of upper portion 50 are no longer aligned with surfaces 56', 58', 60' of base portion 50 such that part of upper portion 50 is situated over and above an upper surface of end rail portion 38 and/or top rail portion 32 (depending upon how one mentally pictures the boundary between rail portions 32, 38 of main siderail body 30.

When the control unit is moved to the raised position, it may be inadvertantly bumped by the occupant of the bed or by a nearby non-occupant. If the upper portion 50 and base 52 are connected by a rigid pivotable connection, the inadvertant bump might break the connection. However a more compliant pivotable connection such as the coil spring 178 described above can withstand the bump without breaking.

In some embodiments, one or more detent mechanisms (not shown) are provided on a bottom surface of the first portion 50 and/or on an upper surface of the top and/or end rail portions 32, 38 such that when the first portion 50 of the patient control unit is pivoted about the vertical axis 54 after the patient control unit has been moved to the raised position, the one or more detent mechanisms will tend to retain the first portion 50 at selected angular orientations such as plus or minus 45 degrees and/or plus or minus 90 degrees from the neutral position (i.e., the position in which surfaces 56, 58, 60 are aligned with surfaces 56', 58', 60'). In other embodiments, one or more detent mechanisms are provided on a bottom surface of upper portion 50 and an upper surface 62, shown in FIG. 9, of base portion 52. Such detent mechanisms may include, for example, a spring loaded ball of a molded projection that projects from one of the surfaces and that is received in a pocket formed in the other of the surfaces. In still other embodiments, a pivot shaft or other pivot mechanism that couples portions 50, 52 of unit 44 together may include a detent mechanism or other type of indexing mechanism that has a tendency to hold portion 50 in one or more misaligned orientations relative to base portion 52. An example of such a mechanism is seen in FIGS. 19-20 where pivot pin 170 is crenelated along part of its perimeter to provide a series of notches 186 and teeth 188. A plunger 190 is urged into contact with the pin by a spring 192. The plunger projects into one of the notches 186 to maintain the relative orientation of portions 50, 52. If a user applies a twisting force to the upper portion, one of the teeth pushes the plunger toward the spring to allow portion 50 to pivot relative to base 52. The plunger then snaps into the next adjacent notch to maintain the new orientation. A pair of stops 192 limits the relative orientation of portions 50, 52.

Figure 6:
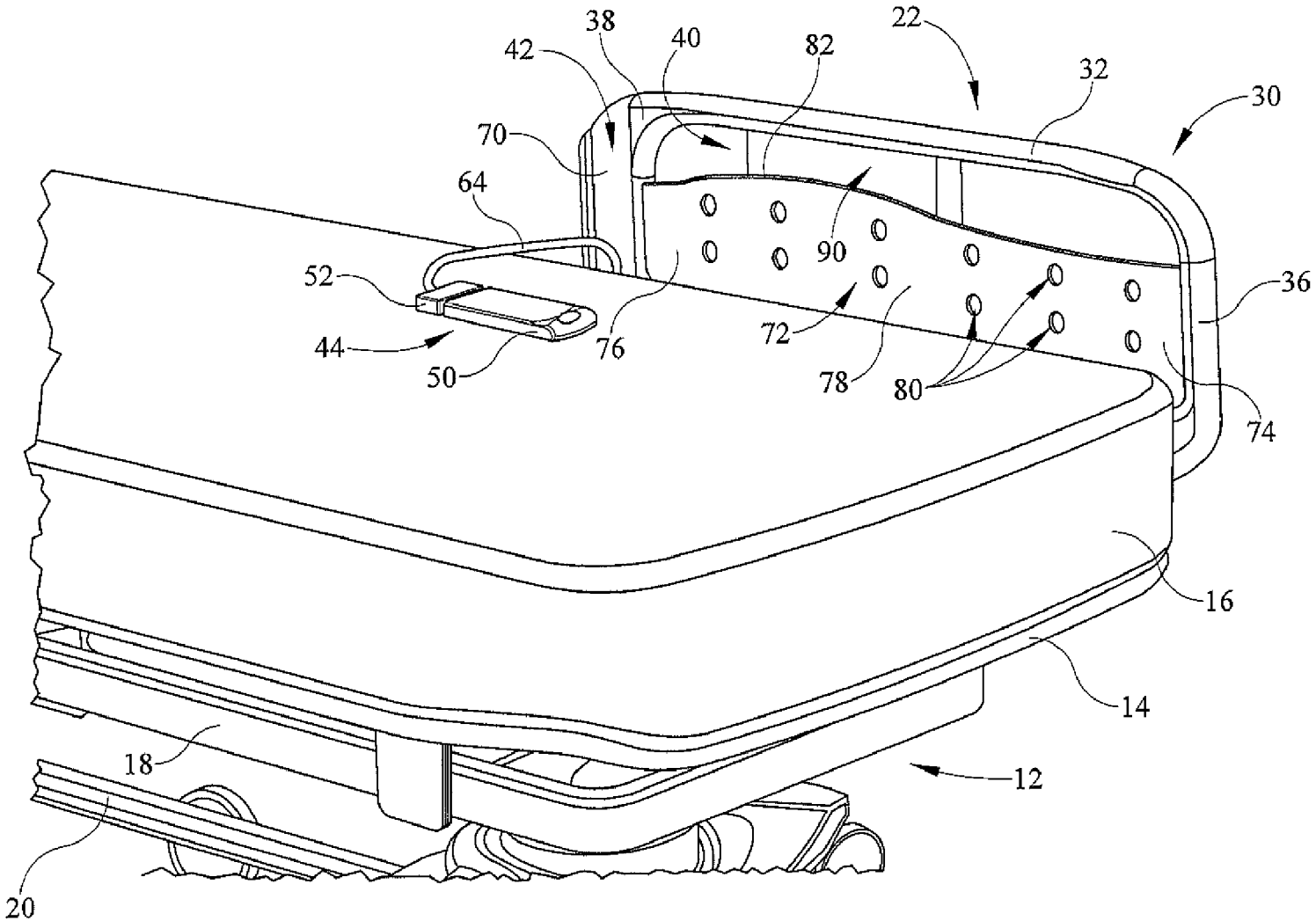
FIG. 6 is a perspective view, similar to FIG. 4, showing the patient control unit removed from the recess altogether and lying on a mattress of the patient support apparatus.

A cord 64 extends from the patient control unit 44 to a portion of the bed such as the frame or siderail to tether the unit to the bed. Alternatively, the cord may couple to a winder 66 carried by the siderail 22 within bottom rail portion 34 as shown in FIG. 5 (in phantom). The winder 66 is spring biased or otherwise operable to automatically wind up the slack of the cord 64 when the patient control unit is returned to the recess 42. The spring bias of winder 66, acting through cord 64, firmly seats unit 44 in the raised position when upper portion 50 is misaligned with base portion 52 and also firmly seats unit 44 against an upwardly facing ledge surface 68 at the bottom of recess 42 when unit 44 is in the lowered position. An optional locking mechanism, such as a detent mechanism, retractable pin, movable latch, and the like, may be provided, if desired, to releasably lock base portion 52 in position in the recess 42 when unit 44 is in the raised position. If such an optional locking mechanism is provided, then unit 44 is able to remain in the raised position without the need to misalign upper portion 50 relative to base portion 52. In the illustrative example, unit 44 is removable from the recess 42 altogether, as shown in FIG. 6, and can be held by the patient to operate the user inputs 46. Alternatively, the control unit can be configured so that the upper portion is separable from the base, irrespective of whether the upper portion and the base are connected by a rigid connection such as pin 170 or by a more compliant connection such as coil spring 178. When so configured it is anticipated, although not necessary, that the base would remain trapped in the recess even when the upper portion is separated from the base.

In some embodiments, cord 64 includes one or more electrical conductors through which signals regarding which of the user inputs 46 are being used by the patient are provided to a controller (not shown) of the patient support apparatus 10. However, this need not be the case if unit 44 is provided with wireless communication capability for wireless transmission of signals to the controller. In such a wireless embodiment, the cord 64 may simply serve as a tether to keep unit 44 from being separated from bed 10 or may be omitted altogether. In the illustrative example, the patient control unit 44 is an elongated hand-held pendant and the recess 42 is a vertically oriented elongated recess that is substantially open at its top and front and substantially closed at its sides, bottom, and back.

In some embodiments, including the illustrative embodiment, unit 44 is slender enough to be held by the patient in a single hand and to have user inputs 46 engaged by the fingers of the same hand. This is an advantage over some prior art user control units which, due to their size, require the patient to use both hands to hold and operate the unit when the unit is not otherwise attached to the siderail of the bed. The illustrative unit 44 has a grip recess 69 which is sized and shaped to receive a patient's finger so facilitate moving the unit 44 from the lowered position to the raised position.

While the user inputs of the patient control unit 44 may be accessible to the patient when the control unit 44 is in both the first and second positions, in the illustrative embodiment, the patient control unit 44 and the recess 42 are configured such that the patient control unit 44 is able to be removed from the recess 42, flipped around, and then reinserted back into the recess 42 in an orientation in which the user inputs 46 are inaccessible to the patient. Thus, the patient control unit 44 is insertable into the recess 42 in a first orientation having the user inputs 46 facing generally toward the patient support deck 14 through the open front of the recess 44 or in a second orientation having the user inputs 46 facing generally away from the patient support deck 14 toward a generally vertical wall 70 of the siderail 22 that bounds the back of the recess 42.

It is contemplated by this disclosure that other types of patient support apparatuses, such as chairs may be outfitted with a similar type of recess and patient control unit arrangement. For example, an armrest of a chair may be provided with a recess that permits an associated patient control unit to be moved substantially vertically within the recess between raised and lowered positions, with the user inputs of the control unit being situated above the arm rest when the control unit is in the raised position. This type of recess may also be provided on an overbed table, such as in a housing of the overbed table from which a table extends in a cantilevered manner. When the control unit is in the raised position, the user inputs may be situated above the table of the overbed table.

Figure 22:
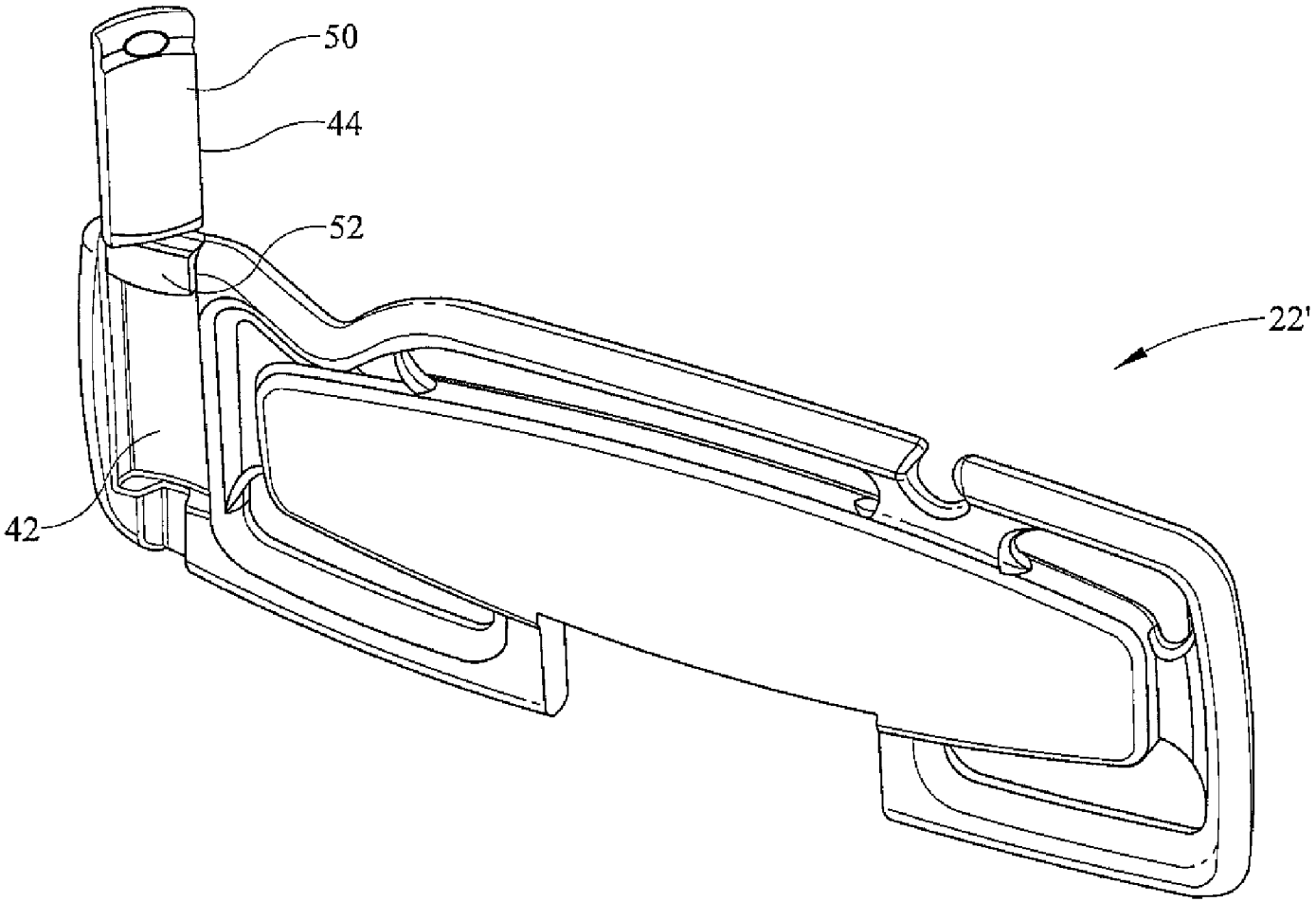
FIG. 22 is a perspective view showing the control unit in the context of an alternative style siderail.
Figure 23:
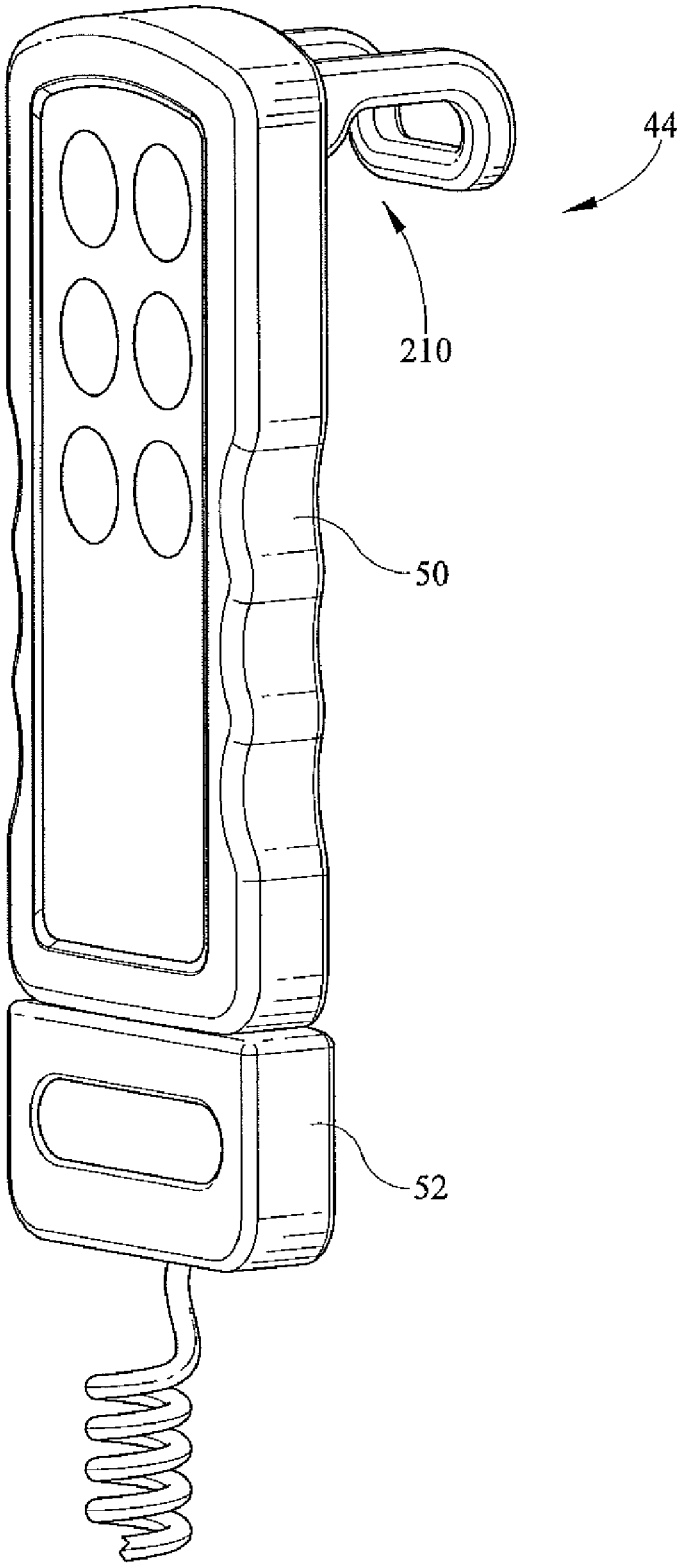
FIGS. 23-25 are perspective views showing a control unit with a hook.
Figure 24:
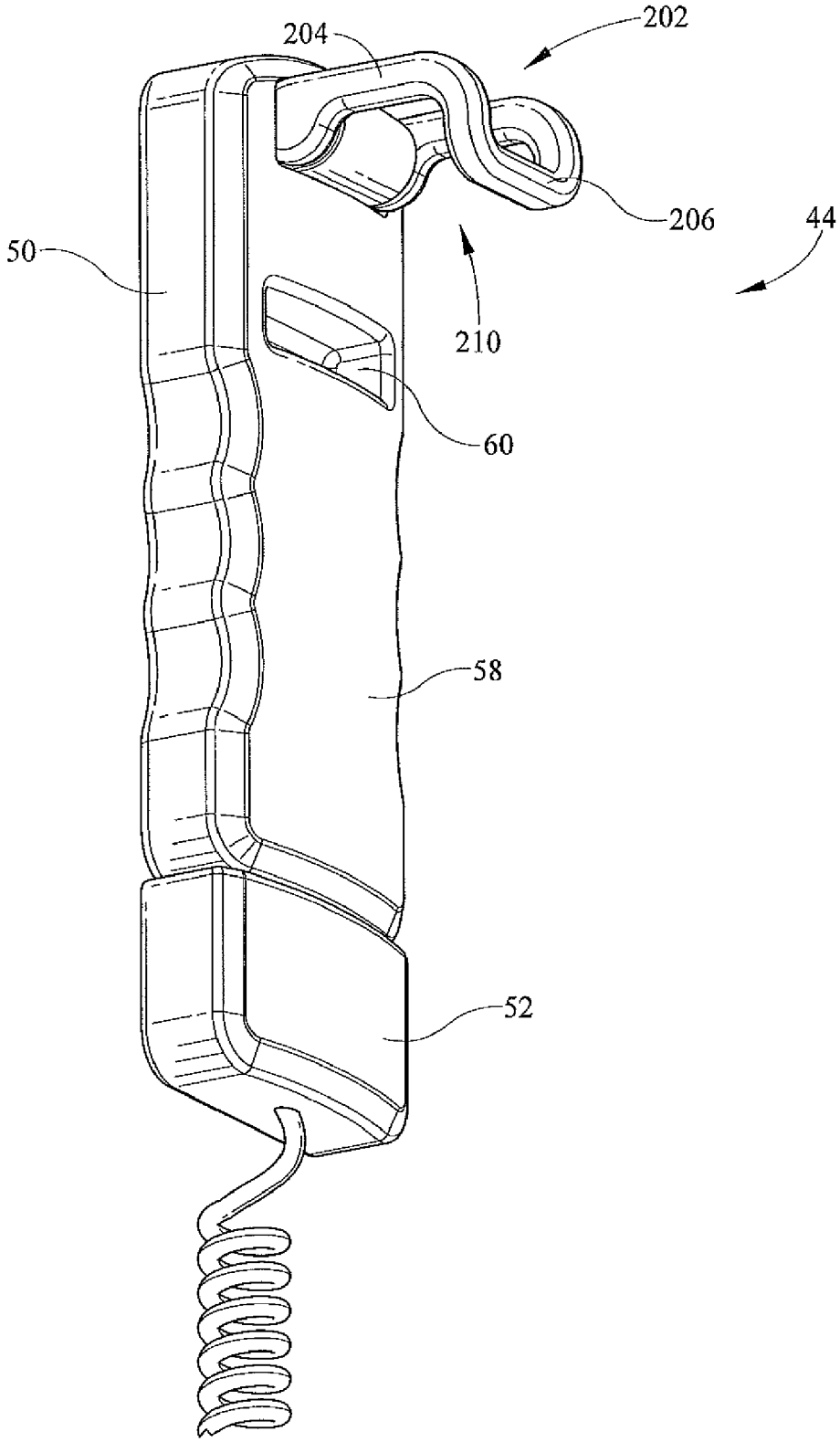
Figure 25:
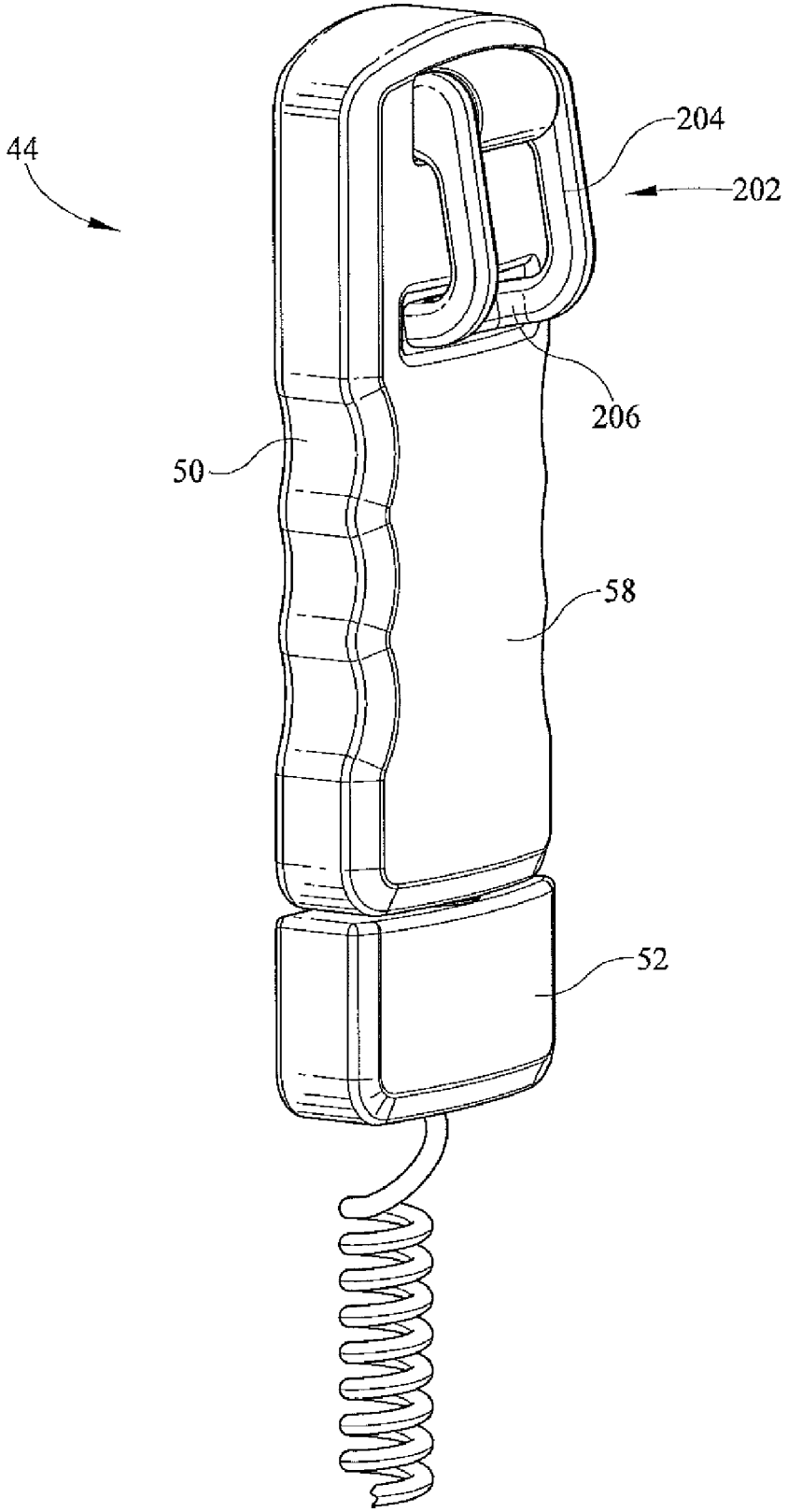

Although the control unit 44 is shown in the context of a flexible panel siderail described in more detail below, the recess 42 can be provided in siderails having other configurations. One example is a more traditional, non-flexible siderail 22' shown in FIG. 22. In addition, although the exemplary unit has a base 52 and an upper portion pivotable relative to the base, the unit may be constructed as a one piece (non-pivotable) unit that can be moved between a first position in which a majority of the unit is received in the recess and a second position in which at least part of the unit resides outside the recess and extends past the perimeter of the siderail and can also be positioned at intermediate positions between the first and second positions.

Figure 26:
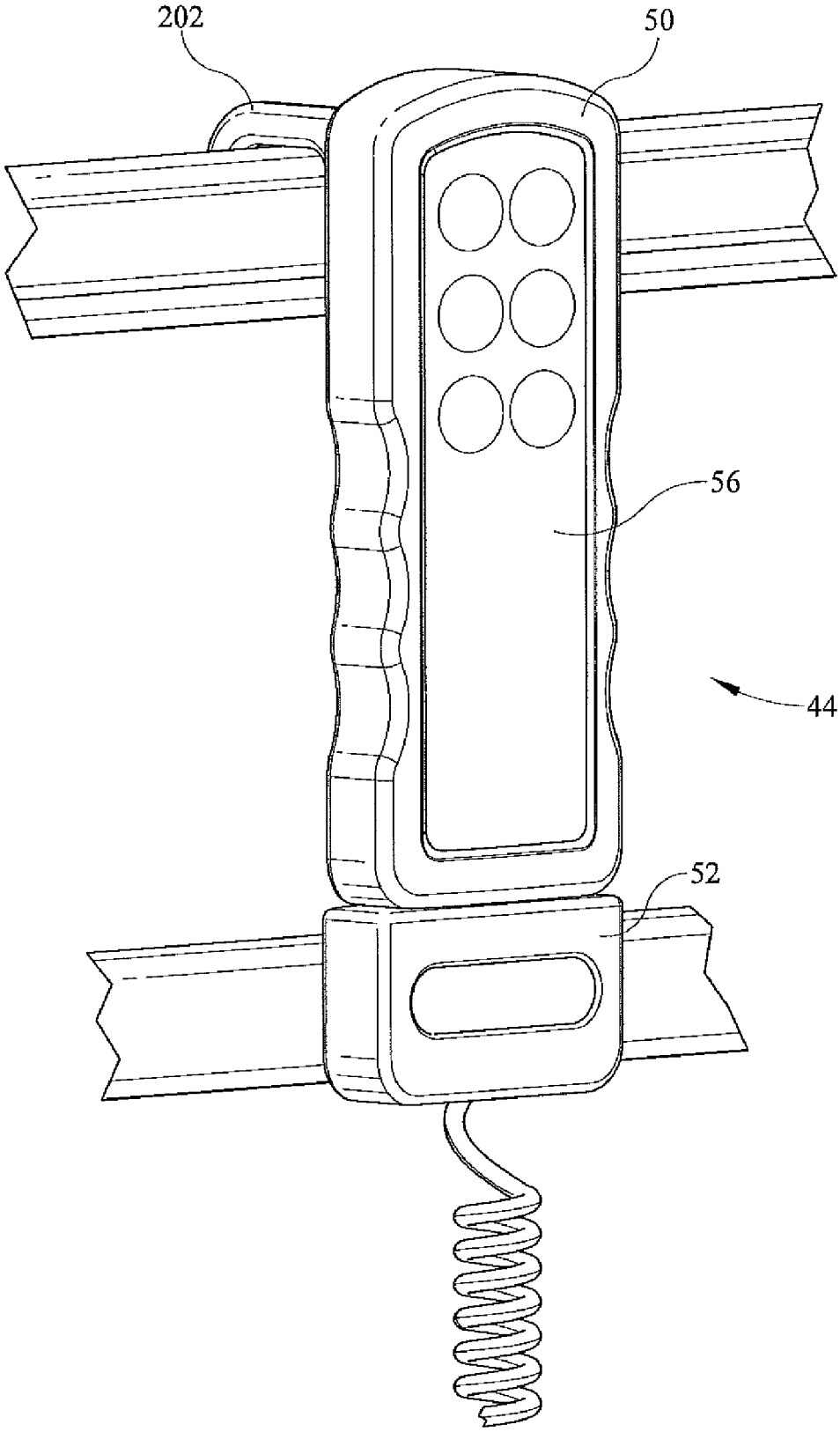
FIG. 26 is a perspective view showing the control unit of FIGS. 23-25 hooked to a siderail.

FIGS. 23-26 show another embodiment of a control unit 44 having a base 52 and an upper portion 50 pivotably connected to the base. The unit 44 has a front surface 56 and a back surface 58 with a pocket 60. The user inputs are on the front surface. The control unit 44 of FIGS. 23-26 also includes a hook 202 comprised of a base leg 204 and a distal leg 206. The distal leg is at a fixed orientation relative to the base leg. The hook partially defines a spatial region 210 whose perimeter has a shape approximately complementary to the cross sectional shape of the siderail when viewed by an observer looking in the longitudinal direction (e.g. from the head end toward the foot end of the bed). As used herein, the shape is approximately complementary to the cross sectional shape of the siderail if the unit can be satisfactorily hung on the siderail by the hook, e.g. as seen in FIG. 26. The base leg of the hook is pivotably connected to the unit 44 for movement between an extended position (FIGS. 23, 24, 26) in which the hook extends away from the back surface and a stowed position (FIG. 25) in which the hook does not extend away from the control unit. With the hook in the extended position the base leg extends substantially perpendicularly to the back surface 58. With the hook in the stowed position the base leg is substantially parallel to the back surface and the distal leg nests in the pocket. When the unit is removed from the recess 44 in the siderail it may be hung on the siderail by way of the hook, if desired, rather than returned to the recess. Although FIGS. 23-26 show a hooked control unit with both a base 52 and an upper portion 50, the hooked variant of the unit 44 may also be constructed as a one-part (non-pivotable) control unit.

In addition, the hooked unit may be used as a stand-alone unit, i.e. without the recess in the siderail.

Figure 27:
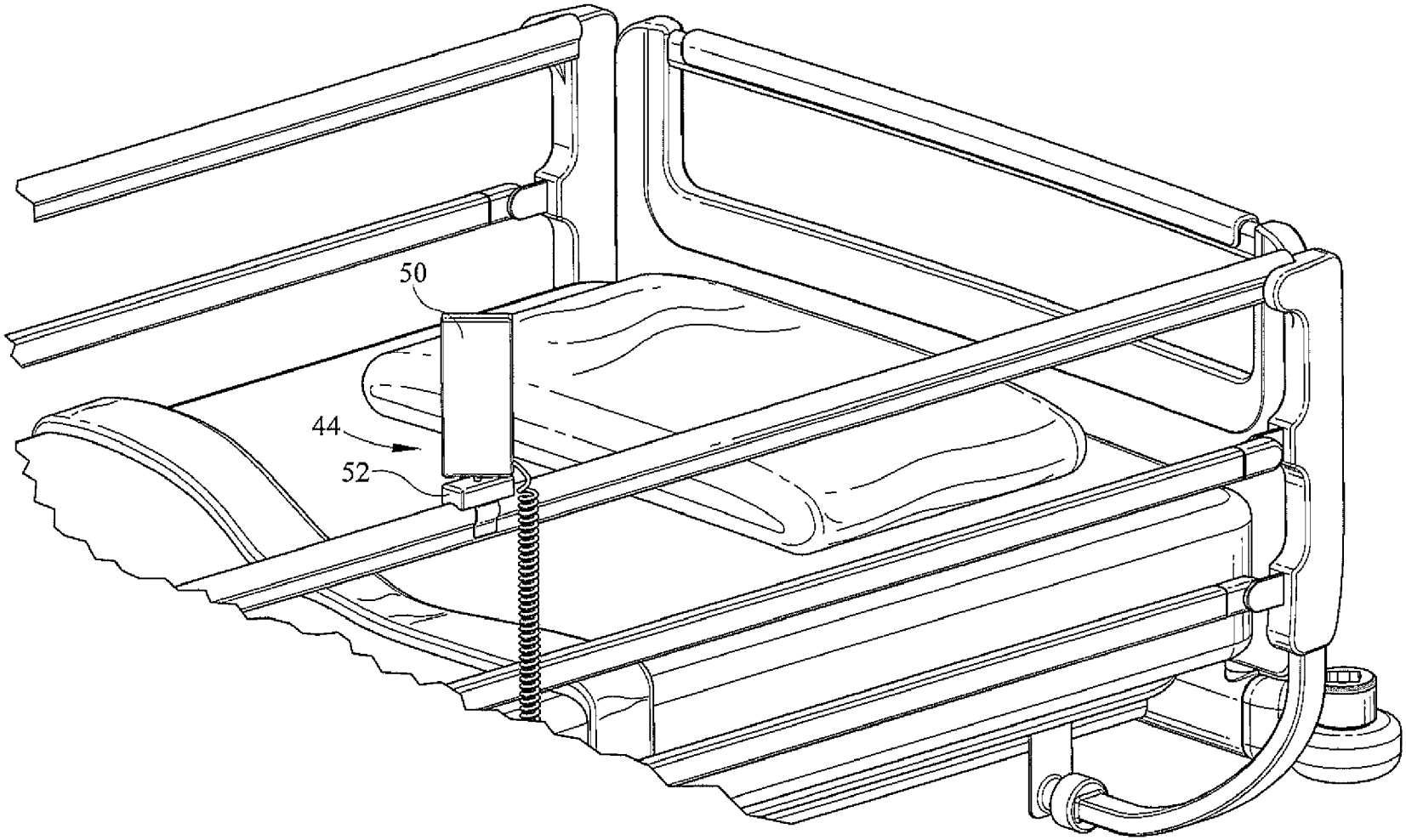
FIGS. 27-28 are perspective views showing a control unit with a clip.
Figure 28:
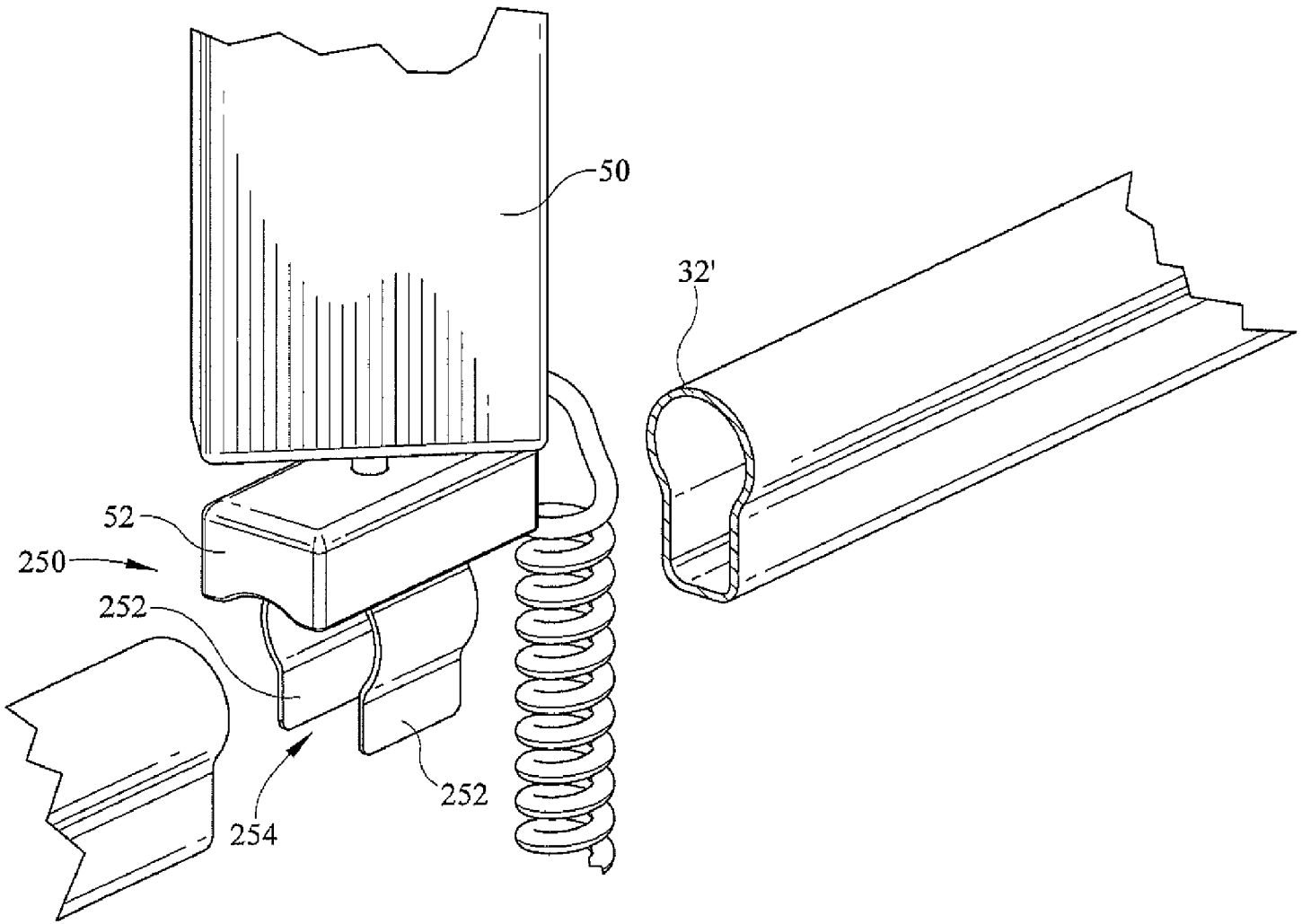

FIGS. 27-28 show another embodiment of the control unit 44 having a base 52 and an upper portion 50 pivotably connected to the base. The base 52 of the illustrated control unit is configured as a clip 250. The illustrated clip includes a pair of wings 252. The wings and the portion of the base that extends laterally between the wings define a spatial region 254 whose perimeter has a shape approximately complementary to the cross sectional shape of the siderail when viewed by an observer looking in the longitudinal direction (e.g. from the head end toward the foot end of the bed). As used herein, the shape is considered approximately complementary to the cross sectional shape of the siderail if the unit can be satisfactorily supported on the siderail by the clip. In the illustrated embodiment the shape is a "keyhole" shape similar to the keyhole shape of the illustrated top portion 32' of a siderail. When the unit is removed from the recess 44 in the siderail it may be clipped on the siderail by way of the clip, if desired, rather than returned to the recess. The clip is slidable along the siderail so that the control unit can be easily repositioned along the length of the siderail. Although FIGS. 27-28 show a clip-on control unit with both a base 52 and an upper portion 50, the clip-on variant of the unit 44 may also be constructed as a one-part (non-pivotable) control unit. In addition, the clip-on unit may be used as a stand-alone unit, i.e. without the recess in the siderail.

The siderail 22 has a flexible panel 72 which is coupled to the main siderail body 30 as shown in FIGS. 1-7 and 11-16. The flexible panel 72 is less rigid than the main siderail body 30 so as to flex more readily than the main siderail body 30 when contacted inadvertently by a patient that is supported above the patient support deck 14 on mattress 16. The head end and foot end portions 74, 76 of flexible panel 72 are situated within the opening 40 of body 30 and are coupled to rail portions 36, 38 and to part of bottom rail portion 34. In other embodiments, panel 72 may be coupled only to one or two of rail portions 34, 36, 38. The end edge regions of end portions 36, 38 of panel 72 may be trapped or squeezed within a seam defined between molded housings that from part of main siderail body 30. A middle portion 78 of the flexible panel bows outwardly toward the patient support deck 14 and mattress 16. Panel 72 is made of plastics material and, in some embodiments, has a uniform thickness throughout the expanse of panel 72. However, that is not to say that panels having varying thickness could not be used. In the illustrative example, panel 72 is provided with a plurality of holes 80 to increase the flexibility of panel 72.

The flexible panel 72 has a top edge 82 that is situated below, and that is spaced-apart from, the top portion 32 of the main siderail body 30. In some embodiments, such as the one shown in FIGS. 11-14, at least a portion of a bottom edge 84 of the middle portion 78 of the flexible panel 72 is situated above, and is spaced-apart from, the bottom portion 34 of the main siderail body 30. Siderail 22 is configured so that, when the siderail is in the raised position, a plane extending from the upper surface of mattress 16 intersects the flexible panel 72 closer to the bottom of panel 72 than to the top of panel 72. That is, a large portion of the panel 72 is higher in elevation than the upper surface of mattress 16 when the siderail 22 is raised, but some amount of the panel 72 is below the upper surface of mattress 16. This configuration and arrangement of panel 72 insures that any portion of the patient's body moving sideways off of the upper surface of mattress 16 toward panel 72 will contact panel 72. In actuality, it is the patient's elbow that is expected to most often come into contact with panel 72. By providing siderail 22 with flexible panel 72, the need to use additional siderail pads to cushion inadvertent contacts by the patient with the siderail is lessened or even eliminated.

According to this disclosure, the flexible panel 72 may be translucent and may be able to be lit up by at least one light source (not shown). Thus, the flexible panel may be made of a material that provides a light pipe type of effect. The at least one light sources may comprise, for example, at least one light emitting diode. The at least one light source may be operable to light up the flexible panel in a first color, green for example, and to light the flexible panel in a second color, yellow or red for example. The light source may be a single LED that is operable to shine light of different colors, such as green and amber or green and red. The different colors may correspond to alert conditions of the bed or patient or may simply be selected for aesthetic purposes, for example, to match the color scheme of the patient room.

According to this disclosure, siderail 22 of the patient support apparatus 10 also has a caregiver control unit 90. In some embodiments such as the one shown in FIGS. 1-7, 15 and 16, unit 90 is coupled to top rail portion 32 and hangs downwardly therefrom. In other embodiments, such as the one shown in FIGS. 11-14, unit 90 projects upwardly from bottom rail portion 34. In each of these embodiments, the flexible panel 72 is configured to bow away from the caregiver control unit 90 and toward the patient support deck 14 and mattress 16.

According to an aspect of this disclosure, the caregiver control unit 90 has a housing 92 with recessed grooves 94 as shown in FIGS. 11-14. User inputs 95 are situated within, or are associated with the grooves 94 such that areas of the housing 92 adjacent the grooves inhibit inadvertent contact of the user inputs. In the illustrative example, the user inputs 95 comprise field disturbance switches or sensors and/or capacitive switches or sensors 96 as shown in FIGS. 13B and 13C. The user inputs 95 further comprises areas within grooves 94 that are touched by the caregiver to control functions of the bed. These areas may have indicia thereon to provide a visual cue to the caregiver regarding where to touch the groove to use the user input 96.

The recessed grooves 94 in the illustrative example each have a substantially vertical orientation. Each groove 94 is shaped to have a concave outwardly facing surface as shown best in FIG. 13B. Each of the recessed grooves 94 is shallower at end regions 98 of the respective groove as compared to a middle region 99 of the respective groove 94 as shown best in FIG. 13C. The shape and orientation of the recessed grooves 94, along with the types of sensors 96 used, facilitates easy cleaning of the caregiver control unit 94 by allowing for wipe down cleaning through the recessed grooves 94. The caregiver control unit 90 has a graphical display screen 100 carried by the housing 92 above the recessed grooves 94.

Figure 13A:
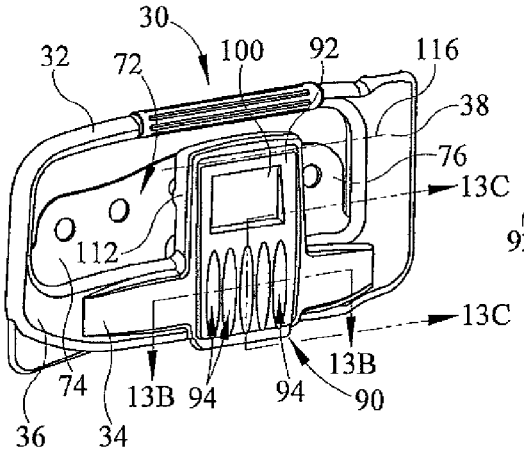
FIG. 13A is a perspective of the siderail of FIG. 11 from another vantage point showing the caregiver control unit having a set of recessed grooves beneath a graphical display screen of the caregiver control unit.
Figure 13B:
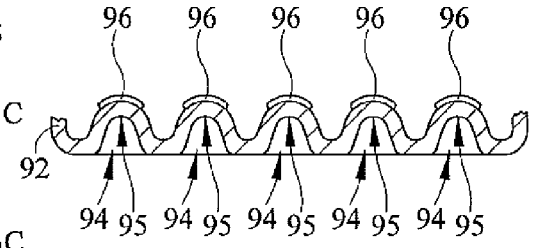
FIG. 13B is a cross sectional view, taken along line 13B-13B of FIG. 13A, showing that each of the recessed grooves is generally semi-circularly concave for ergonomic receipt of the tip of a caregiver's finger which is sensed by user inputs that are associated with each of the recessed grooves.
Figure 13C:
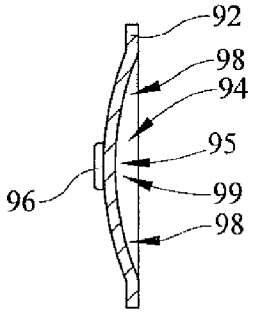
FIG. 13C is a cross section view, taken along line 13C-13C of FIG. 13A, showing one of the recessed grooves being shallower in depth at the upper and lower ends of the groove than in the middle region of the groove.
Figure 14:
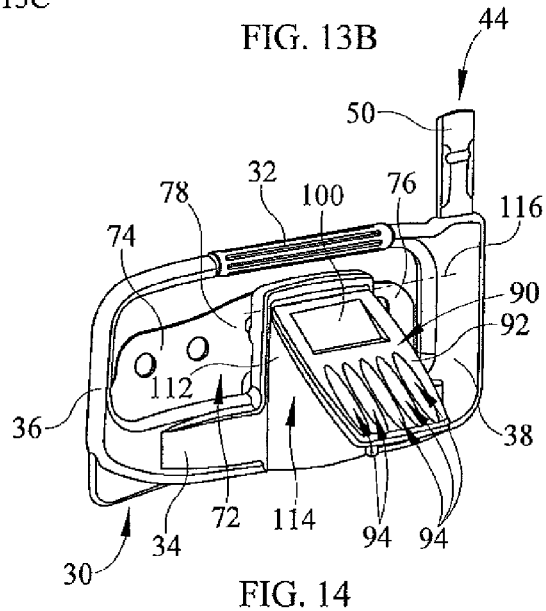
FIG. 14 is a perspective view, similar to FIG. 13A, showing the caregiver control unit being pivoted out of a cavity of the siderail to a use position having the graphical display screen and recessed grooves facing generally upwardly for easier use by a caregiver.
Figure 15:
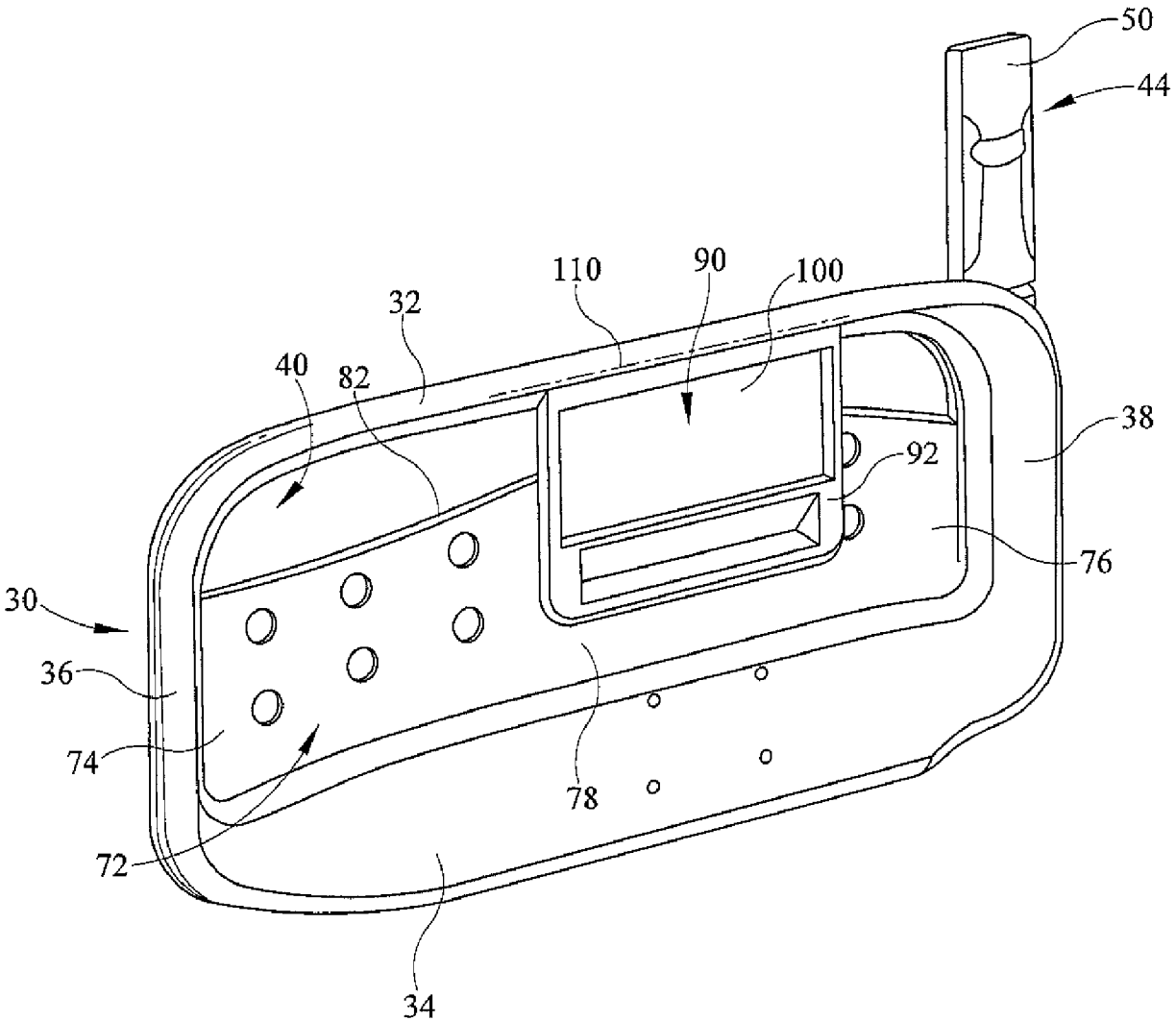
FIG. 15 is an enlarged perspective view of the siderail of FIGS. 1-7.
Figure 16:
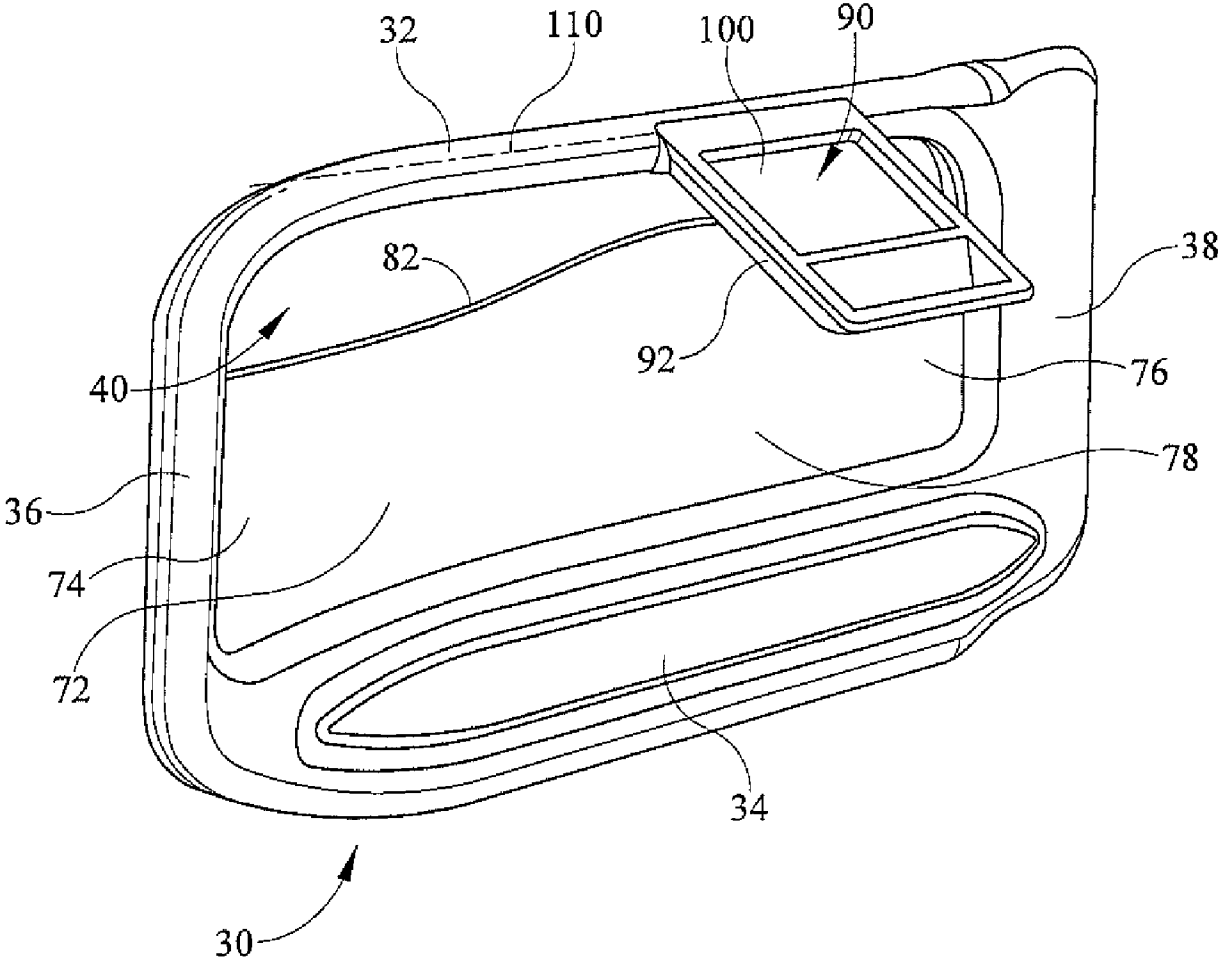
FIG. 16 is a perspective view, similar to FIG. 15, showing the caregiver control unit pivoted relative to the top rail portion of the siderail to a use position having the graphical display screen facing generally upwardly for easier use by a caregiver.

Top rail portion 32 defines a generally horizontal axis 110 as shown in FIGS. 15 and 16. In some embodiments in which the caregiver control unit 90 is coupled to the top rail portion 32, unit 90 is pivotable about the generally horizontal axis 110 out of opening 40 into an inclined orientation as shown in FIG. 16. In the embodiment shown in FIGS. 11-14, siderail 22 has an upwardly protruding portion 112 situated about midway between a head end and foot end of the bottom rail portion 34. A cavity 114, shown best in FIG. 14, is provided in the upwardly protruding portion 112 and in the part of the bottom rail portion 34 beneath potion 112. It should be noted that, conceptually, portion 112 may be considered part of portion 34, although is has been described herein as being another portion of body 30 that protrudes upwardly from portion 34. The cavity 114 is sized and configured to receive the caregiver control unit 90 therein when the unit 90 is in a storage position as shown in FIG. 13A. An upper portion of the caregiver control unit 90 is pivotably coupled to an upper region of the upwardly protruding portion 112 for pivotable movement about a generally horizontal axis 116 such that the caregiver control unit 90 is movable between the storage position within the cavity 114 and a use position extending out of the cavity 114 as shown in FIG. 14. In the use position, screen 100 and user inputs 95 face generally upwardly which facilitates easier use of the control unit 90 by the caregiver.

Although certain illustrative embodiments have been described in detail above, variations and modifications exist within the scope and spirit of this disclosure as described and as defined in the following claims.

The invention claimed is:

1. An occupant support apparatus comprising a frame including an occupant support deck above which an occupant is supportable, a siderail having a raised position in which at least a portion of the siderail is higher in elevation than the occupant support deck, the siderail having a recess therein; and a control unit having user inputs configured to be engaged by a user, the control unit being generally vertically slidable within the recess relative to the siderail between a lowest position in which at least a majority of the control unit is received in the recess and a highest position in which at least a majority of the control unit resides outside the recess and extends past a perimeter of the siderail, the control unit having a base that can remain in the recess when the control unit is in the highest position, and an upper portion which carries the user inputs and which is pivotable relative to the base about a generally vertical axis.

2. The apparatus of claim 1 wherein the recess is in an end rail portion of the siderail.

3. The apparatus of claim 1 wherein the control unit is positionable at one or more intermediate positions between the lowest and highest positions.

4. The apparatus of claim 3, wherein the user inputs of the control unit are accessible to an occupant of the apparatus when the control unit is in the highest, lowest and intermediate positions.

5. The apparatus of claim 1 such that when the control unit is at the highest position and the upper portion of the control unit is pivoted about the vertical axis, part of the upper portion is situated over and above an upper surface of an end rail portion and/or a top rail portion of the siderail so that the rail portion or portions resist movement of the unit away from the highest position toward the lowest position.

6. The apparatus of claim 1 wherein the upper portion is separable from the base.

7. The apparatus of claim 1, wherein the control unit and the recess are configured such that the control unit can be removed from the recess, flipped around, and then reinserted into the recess in an orientation in which the user inputs are inaccessible to the occupant.

8. The apparatus of claim 1, wherein the control unit is removable from the recess altogether to be held by an occupant away from the siderail.

9. The apparatus of claim 8, further comprising a cord that extends from the control unit and that couples to a winder carried by the siderail.

10. The apparatus of claim 1, wherein the siderail is movable to a lowered position permitting the patient to exit the occupant support deck without obstruction from the siderail.

11. The apparatus of claim 1, wherein the control unit comprises an elongated hand-held pendant and the recess comprises a vertically oriented elongated recess that is substantially open at its top and front and substantially closed at its sides, bottom, and back.

12. The apparatus of claim 1 wherein the base is connected to the upper portion by a laterally and longitudinally compliant pivotable connection.

13. The apparatus of claim 1 wherein the control unit has a front surface and a back surface, the user inputs are on the front surface and the control unit also includes a hook pivotable to an extended position in which the hook extends away from the back surface and a stowed position in which the hook does not extend away from the back surface.

14. The apparatus of claim 13 wherein the back surface of the control unit includes a pocket and the hook comprises:

a base leg that extends substantially perpendicular to the back surface when the hook is in the extended position;

a distal leg extending substantially non-parallel to the base leg;

the base leg being pivotably connected to the control unit for movement between the extended position and the stowed position such that with the hook in the stowed position the base leg is substantially parallel to the back surface and the distal leg nests in the pocket.

15. The apparatus of claim 1 wherein the base is configured as a clip with a shape approximately complementary to that of a host siderail.

16. The apparatus of claim 15 wherein the clip comprises a pair of wings.

17. The apparatus of claim 15 wherein the clip is slidable along the siderail so that the control unit can be repositioned along the length of the siderail.

18. An occupant support apparatus comprising a frame including an occupant support deck above which an occupant is supportable, a siderail having a raised position in which at least a portion of the siderail is higher in elevation than the occupant support deck, the siderail having a recess therein; and a control unit having user inputs configured to be engaged by a user, the control unit being movable relative to the siderail between a first position in which at least a majority of the patient control unit is received in the recess and a second position in which at least part of but less than all of the control unit resides outside the recess and extends past a perimeter of the siderail, the control unit having an upper portion and a base, the upper portion being pivotable relative to the base about a substantially vertical axis when the control unit is in the second position.

19. The apparatus of claim 18, wherein the control unit is movable generally vertically within the recess when moved between the first and second positions.

20. The apparatus of claim 18 wherein the first position is a lowest position, the second position is a highest position and the control unit is positionable at one or more intermediate positions between the lowest and highest positions.

21. The apparatus of claim 20, wherein the user inputs of the control unit are accessible to an occupant of the apparatus when the control unit is in the first, second and intermediate positions.

22. The apparatus of claim 18, wherein the user inputs are carried by the upper portion of the control unit.

23. The apparatus of claim 18 such that when the upper portion of the control unit is pivoted about the vertical axis, part of the upper portion can be situated over and above an upper surface of an end rail portion and/or a top rail portion of the siderail so that the rail portion or portions resist movement of the unit away from the second position toward the first position.

24. The apparatus of claim 18 wherein the base is connected to the upper portion by a laterally and longitudinally compliant pivotable connection.

25. The apparatus of claim 18 wherein the upper portion of the control unit is separable from the base.

26. The apparatus of claim 18, wherein the control unit and the recess are configured such that the control unit can be removed from the recess, flipped around, and then reinserted into the recess in an orientation in which the user inputs are inaccessible to the occupant.

27. The apparatus of claim 18, wherein the siderail is movable to a lowered position permitting the patient to exit the occupant support deck without obstruction from the siderail.

28. The apparatus of claim 18, wherein the control unit comprises an elongated hand-held pendant and the recess comprises a vertically oriented elongated recess that is substantially open at its top and front and substantially closed at its sides, bottom, and back.

29. The apparatus of claim 18 wherein the control unit has a front surface and a back surface, the user inputs are on the front surface and the control unit also includes a hook pivotable to an extended position in which the hook extends away from the back surface and a stowed position in which the hook does not extend away from the back surface.

30. The apparatus of claim 29 wherein the back surface of the control unit includes a pocket and the hook comprises:

a base leg that extends substantially perpendicular to the back surface when the hook is in the extended position;

a distal leg extending substantially non-parallel to the base leg;

the base leg being pivotably connected to the control unit for movement between the extended position and the stowed position such that with the hook in the stowed position the base leg is substantially parallel to the back surface and the distal leg nests in the pocket.

31. The apparatus of claim 18 wherein the base is configured as a clip with a shape approximately complementary to that of a host siderail.

32. The apparatus of claim 31 wherein the clip comprises a pair of wings.

33. The apparatus of claim 31 wherein the. clip is slidable along the siderail so that the control unit can be repositioned along the length of the siderail.

* * * * *